US010989406B2

(12) United States Patent
Nett et al.

(10) Patent No.: US 10,989,406 B2
(45) **Date of Patent: *Apr. 27, 2021**

(54) COMPACT INWARD-FIRING PREMIX FUEL COMBUSTION SYSTEM, AND FLUID HEATING SYSTEM AND PACKAGED BURNER SYSTEM INCLUDING THE SAME

(71) Applicant: Fulton Group N.A., Inc., Pulaski, NY (US)

(72) Inventors: Carl Nicholas Nett, Sandisfield, MA (US); Alireza Bahrami, Cicero, NY (US); Keith Richard Waltz, Sandy Creek, NY (US)

(73) Assignee: FULTON GROUP N.A., INC., Pulaski, NY (US)

( * ) Notice: Subject to any disclaimer, the term of this patent is extended or adjusted under 35 U.S.C. 154(b) by 134 days.

This patent is subject to a terminal disclaimer.

(21) Appl. No.: 16/285,119

(22) Filed: Feb. 25, 2019

(65) Prior Publication Data

US 2019/0264910 A1 Aug. 29, 2019

Related U.S. Application Data

(60) Provisional application No. 62/634,520, filed on Feb. 23, 2018, provisional application No. 62/634,476, filed on Feb. 23, 2018.

(51) Int. Cl.
*F23D 14/16* (2006.01)
*F23D 14/02* (2006.01)
(Continued)

(52) U.S. Cl.
CPC ..... *F23D 14/16* (2013.01); *F23D 14/02* (2013.01); *F23D 14/583* (2013.01); *F23R 3/286* (2013.01);
(Continued)

(58) Field of Classification Search
CPC ..... F23D 14/02; F23D 14/14; F23D 14/58; F23D 14/16; F23D 2203/1026;
(Continued)

(56) References Cited

U.S. PATENT DOCUMENTS 3,122,197 A * 2/1964 Saponara ..... F23D 14/145 431/329
3,881,863 A 5/1975 Creuz
(Continued)

FOREIGN PATENT DOCUMENTS

EP 0 924 470 A2 6/1999
EP 1 813 864 A2 8/2007
(Continued)

OTHER PUBLICATIONS

International Search Report for International Application No. PCT/US2019/019441 dated Jun. 19, 2019.
(Continued)

*Primary Examiner* — David J Laux
*Assistant Examiner* — Nikhil P Mashruwala
(74) *Attorney, Agent, or Firm* — McCormick, Paulding & Huber PLLC

(57) ABSTRACT

An inward-firing combustion burner, includes a burner casing configured to receive a fuel-air mixture at a burner inlet and to provide hot combustion gas at a burner output, a combustion substrate disposed within the burner casing, the substrate having a shape comprising at least a semi-cone or a flat surface, having a substrate porosity defined by a plurality of pores, and having a substrate inner surface and a substrate outer surface, the substrate configured to receive the fuel-air mixture at the outer surface of the substrate, the fuel-air mixture passing through the pores at a mixture flow rate from the substrate outer surface toward the substrate inner surface, and the burner configured such that, in opera-
(Continued)

tion, the fuel-air mixture ignites near the plurality of pores to form a respective plurality of flamelets, each flamelet corresponding to one of the pores.

16 Claims, 24 Drawing Sheets

(51) Int. Cl.
*F23R 3/28* (2006.01)
*F23D 14/58* (2006.01)

(52) U.S. Cl.
CPC .. *F23D 2203/102* (2013.01); *F23D 2203/105* (2013.01); *F23D 2203/1017* (2013.01); *F23D 2203/1026* (2013.01)

(58) Field of Classification Search
CPC ..... F23D 2203/102; F23D 2203/1017; F23D 2203/105; F23R 3/286
See application file for complete search history.

(56) References Cited

U.S. PATENT DOCUMENTS 3,881,869 A * 5/1975 Neti ..... G01N 31/00 436/135
5,380,192 A * 1/1995 Hamos ..... F23D 14/02 431/328
6,202,420 B1 3/2001 Zarzalis et al.
6,575,736 B1 * 6/2003 Aust ..... F23D 14/14 431/328
6,612,295 B2 * 9/2003 Lerner ..... F02M 35/10078 123/593
2006/0025199 A1 11/2006 Lamberts et al.
2006/0251998 A1 * 11/2006 Lamberts ..... F23D 14/145 431/350
2009/0032012 A1 * 2/2009 von Herrmann ..... F24C 3/04 126/39 J
2010/0077731 A1 4/2010 Jeong et al.
2013/0280662 A1 * 10/2013 Dreizler ..... F23D 14/14 431/12
2016/0116160 A1 4/2016 Takeuchi
2019/0293285 A1 * 9/2019 Nett ..... F23D 17/002
2019/0363316 A1 * 11/2019 Lee ..... H01M 2/0426
2020/0386400 A1 * 12/2020 Nett ..... F23D 14/14

FOREIGN PATENT DOCUMENTS

EP 2 713 105 A1 4/2014
KR 10-0568027 B1 4/2006
KR 10-2017-0075494 A 7/2017

OTHER PUBLICATIONS

Written Opinion for International Application No. PCT/US2019/019441 dated Jun. 19, 2019.
International Search Report for International Application No. PCT/IB2019/054959 dated Nov. 18, 2019.
Written Opinion for International Application No. PCT/IB2019/054959 dated Nov. 18, 2019.
International Search Report for International Application No. PCT/US2019/019460 dated Apr. 16, 2019.
Written Opinion for International Application No. PCT/US2019/019460 dated Apr. 16, 2019.

* cited by examiner

COMPACT INWARD-FIRING PREMIX FUEL COMBUSTION SYSTEM, AND FLUID HEATING SYSTEM AND PACKAGED BURNER SYSTEM INCLUDING THE SAME

CROSS REFERENCE TO RELATED APPLICATIONS

This application claims priority to U.S. provisional patent application Ser. No. 62/634,476, filed on Feb. 23, 2018 and U.S. provisional patent application Ser. No. 62/634,520, filed on Feb. 23, 2018, the content of which are incorporated herein by reference in their entirety to the extent permissible by applicable law.

BACKGROUND

(1) Field

This application relates to a compact premix fuel combustion system for the purpose of heat generation, methods of using a premix fuel combustion system, and methods of fluid heating incorporating a compact premix fuel combustion system.

(2) Description of the Related Art

Premix fuel combustion systems are used to provide a heated thermal transfer fluid for a variety of commercial, industrial, and domestic applications such as hydronic, steam, and thermal fluid boilers, for example. Because of the desire for improved energy efficiency, compactness, reliability, and cost reduction, there remains a need for improved premix fuel combustion systems, as well as improved methods of manufacture thereof.

Incomplete combustion, suboptimal combustion product flow fields, and large temperature gradients can result in a decrease in overall burner system performance. This is particularly true of combustion systems incorporated into fluid heating systems for the production of hot water, steam, and thermal fluid for hot liquid or steam for ambient temperature regulation, hot water consumption, or commercial and industrial applications. Moreover, residential, commercial, industrial and government uses of combustion systems for a variety of applications benefit from improvements that decrease the size, volume and footprint of these apparatuses, particularly those that utilize premix fuel and air (oxygen) combinations. Thus, there remains a need for an improved compact premix fuel combustion system having improved thermal efficiency.

SUMMARY

Disclosed herein is an inward firing premix burner combustion system.

Also disclosed is an inward firing premix burner combustion system with a composite semi-cone combustion substrate.

Also disclosed is an inward firing premix burner combustion system with a composite semi-cone combustion substrate and a guide or baffle for directing the fuel-air mixture.

The above described and other features are exemplified by the following figures and detailed description.

BRIEF DESCRIPTION OF THE DRAWINGS

Referring to the figures, which are exemplary embodiments, and wherein the like elements are numbered alike.

DETAILED DESCRIPTION

As further discussed herein, the Applicants have discovered that outward firing combustion systems can suffer incomplete combustion due to the small and constrained combustion volume available, large temperature gradients that can result in material and performance failures, and undesirable flow characteristics of the hot combustion gases and products can be produced in the apparatus.

Disclosed is an improved premix fuel combustion system for applications that require heat generation which provides improved efficiency, apparatus lifecycle and performance by alleviating or eliminating these disadvantages.

Figure 1A:
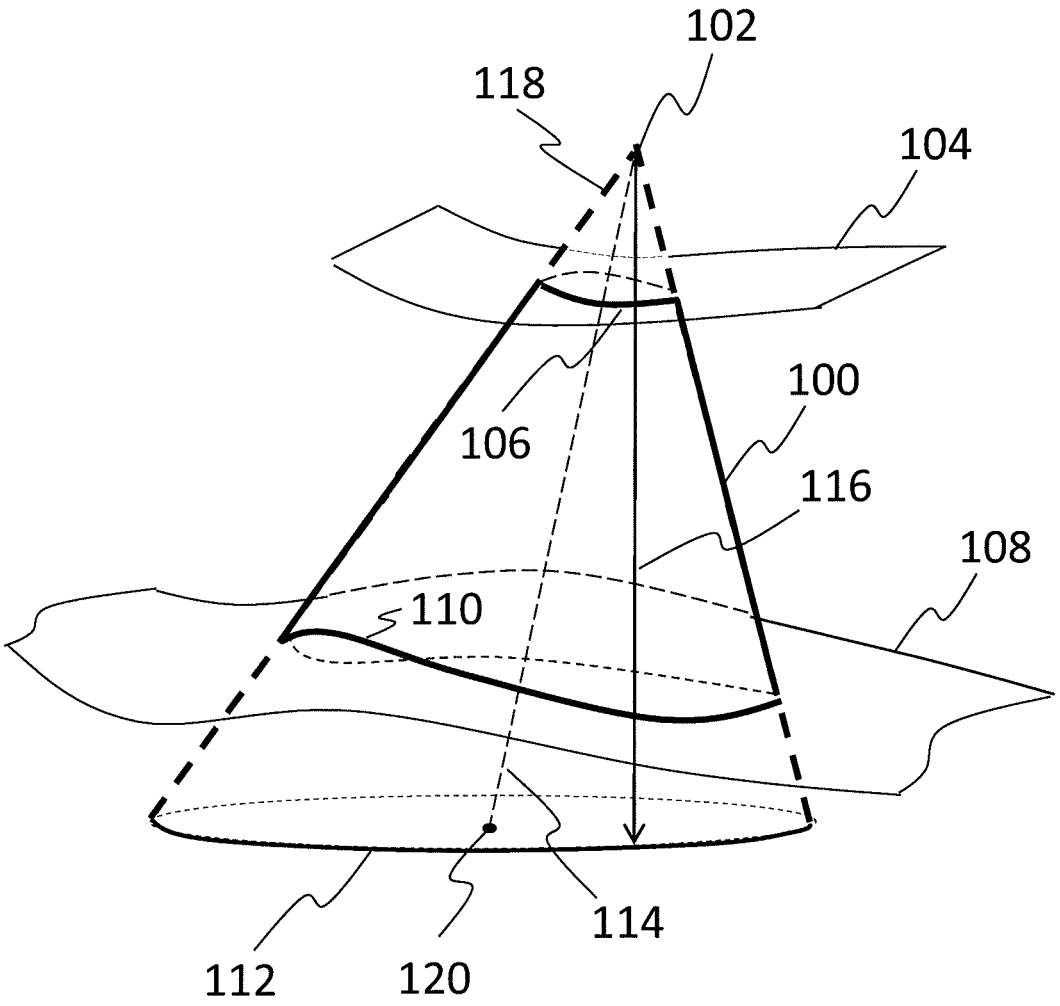
FIG. 1A shows an illustration of the elements used to define semi-cone geometry, in accordance with embodiments of the present disclosure.
Figure 1B:
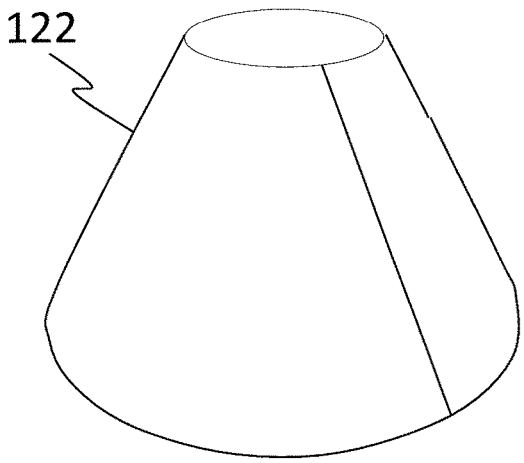
FIG. 1B shows a perspective diagram of a truncated cone in accordance with embodiments of the present disclosure.
Figure 1C:
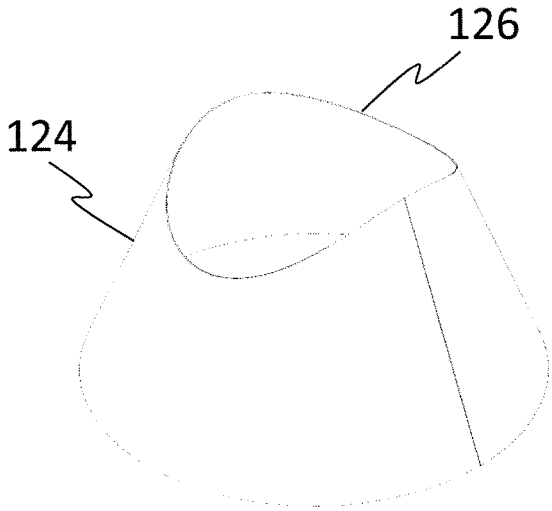
FIG. 1C shows a perspective diagram of a semi-cone in accordance with embodiments of the present disclosure.
Figure 1D:
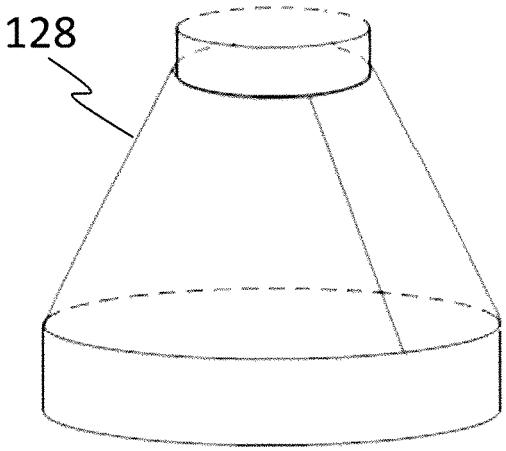
FIG. 1D shows a perspective diagram of a composite semi-cone in accordance with embodiments of the present disclosure.
Figure 1E:
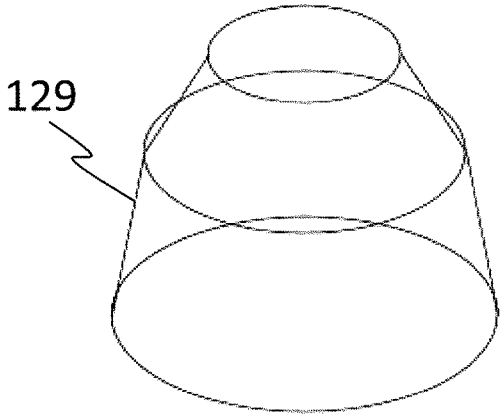
FIG. 1E shows a perspective diagram of a composite semi-cone without cylindrical sections in accordance with embodiments of the present disclosure.

While not wanting to be bound by theory, the following nomenclature is useful in the detailed description that follows:

Consistent with convention, a cone is a geometric surface that can be used to describe certain aspects of embodiments of the present disclosure, e.g., a combustion surface or substrate (as discussed hereinafter). FIG. 1A illustrates key concepts. A cone 118 is a surface defined by a ray called the generator 116 emanating from a fixed point called the vertex 102 which intersects a fixed plane curve called the directrix 112. The directrix, as a geometric curve, need not be either continuous or convex but, when it is, it defines an interior to the cone (normal vector oriented toward the volume containing the intersection with the axis) and an exterior. The axis 114 of the cone is the straight line passing between the vertex 102 and center 120 of the plane curve defined by the directrix 112. If the axis 114 is perpendicular to the plane of the directrix 112, it is a right cone; otherwise, it is an oblique cone. If the directrix 112 is a circle, the cone 118 is a circular cone. If the axis 114 is perpendicular to the directrix 112 plane for a circular cone, the cone 118 is a right-circular cone. A semi-cone 100 is a section of a cone surface bounded between by intersecting a cone with at most two 2-dimensional surfaces. In FIG. 1A, the illustrated cone 118 is intersected by a surface 104 proximal to the vertex 102, forming an upper or proximal semi-cone edge 106. The surface 104 need not be planar or perpendicular to the axis 114 or any generator 116, and the proximal edge 106 need not be a plane curve. The illustrated cone in FIG. 1A is also intersected by a surface 108 distal from the vertex 102, forming a lower or distal edge 110. The surface 108 need not be planar or perpendicular to the axis 114 or any generator 116, and the distal edge 110 need not be a plane curve. The resulting semi-cone 100 is the surface of the cone 118 bounded above by the proximal edge 106 and by the distal edge 110 below. In the degenerate case, the proximal surface 104 intersects the cone 118 only at the vertex 102, wherein the semi-cone 100 is the surface of the cone 118 between the vertex 102 and the distal edge 110. FIG. 1C show a perspective diagram of a semi-cone 124 with a non-planar proximal edge 126. A semi-cone wherein the cone 118 is intersected by proximal 104 and distal planar surfaces 108 is a truncated cone. A semi-cone wherein the cone 118 is intersected by parallel proximal 104 and distal planar surfaces 108 is a frustum. A semi-cone wherein the cone 118 is a right circular cone, the proximal 104 and distal surfaces 108 are planar and perpendicular to the axis 114 is a right frustum. FIG. 1B shows a perspective diagram of a right frustum 122. A composite semi-cone is a composition of one or a plurality of semi-cones and zero, one or a plurality of cylinders disposed along their edges. FIG. 1D shows a perspective diagram of a composite semi-cone 128. FIG. 1E shows a perspective diagram of a composite semi-cone 129 without a cylindrical section.

For a semi-cone, the generator angle (alpha or a, as discussed further herein, e.g., regarding an angle of a combustion surface or substrate as described herein) is the angle 114 formed between a specific generator ray 116 and the axis 114 at the vertex 102. For a right circular semi-cone, right circular truncated cone or right circular frustum, all the generator angles are equal and a unique generator angle can be determined.

A semi-cone with a generator angle of ninety degrees (90°) is a flat plate, surface, disk or annulus and the limit of a family of semi-cones that share a common distal end dimensions and shape.

A burner is a combustion system designed to provide thermal energy through a combustion process to apparatuses used for a variety of applications. The burner may include, depending upon the fuel, combustion geometry and target application, a burner head that supports the combustion process, one or a plurality of nozzles or orifices, air blower with damper, burner control system, shut-off devices, fuel regulator, fuel filters, fuel pressure switches, air pressure switches, flame detector, ignition devices, air damper and fuel valves and fittings. Typical burner systems range in capacity from 30 kW to 1,500 kW (approximately 40 HP to 2,100 HP) and can be adapted to a wide range of uses including incinerators, boilers, drying systems, industrial ovens and furnaces.

A package burner is a burner combustion system designed to be incorporated as a standalone modular subsystem unit into apparatuses used for a variety of applications. The package burner may include, depending upon the fuel, combustion geometry and target application, an integrated subsystem comprising a burner head that supports the combustion process, one or a plurality of nozzles or orifices, air blower with damper, burner control system, shut-off devices, fuel regulator, fuel filters, fuel pressure switches, air pressure switches, flame detector, ignition devices, air damper and fuel valves and fittings. Typical package burner systems range in capacity from 30 kW to 1,500 kW (approximately 40 HP to 2,100 HP) and can be adapted to a wide range of uses including incinerators, boilers, drying systems, industrial ovens & furnaces.

In the discussion that follows, we distinguish three types of physical combustion mechanisms. First, "volume combustion" occurs where a fuel-air mixture is ignited in a spatial volume. A physical structure may contain the combustion process, such as in a cavity burner, but the details of the structure do not directly participate in the thermodynamic combustion process. Second, for "surface combustion", the combustion process (or a majority thereof) occurs directly upon—or very near, or largely in contact with—a burner combustion surface. In some cases, some form of physical insulating or separation layer may be needed at the burner surface to ensure the burner surface does not get too hot or to provide otherwise needed separation from the surface. The physical, geometrical and material characteristics of the surface contribute to determining the thermodynamic physics. Third, in "suspended flame combustion" (SF combustion), the combustion process (or a majority thereof) occurs near—but not directly on—the surface of a combustion substrate, which provides physical support for the generation of the flame front. In some conditions, a small portion of the flame may contact the burner surface (as described more hereinafter). In SF combustion, the flame front (or a majority thereof) is suspended near a positional equilibrium at a distance from the substrate determined partly by a balance of opposing forces due to fuel-air mass flow and flame migration toward its fuel source. If the fuel-air mass flow is reduced below a threshold, the flame front can approach the substrate and enter a regime of surface combustion. If the fuel-air mass flow is increased above a threshold, the flame front can enter a regime of volume combustion.

A boiler is a fluid heating system incorporating a heat exchanger that may be used to exchange heat between any suitable fluids, e.g., a first fluid and the second fluid, wherein the first and second fluids may each independently be a gas or a liquid. In the disclosed system, the first fluid, which is directed through the heat exchanger core, is a thermal transfer fluid, and may be a combustion gas, e.g., a gas produced by fuel fired combustor, and may comprise water, carbon monoxide, nitrogen, oxygen, carbon dioxide, combustion byproducts or combination thereof. The thermal transfer fluid may be a product of combustion from a hydrocarbon fuel such as natural gas, propane, or diesel, for example.

Also, the second fluid, which is directed through the pressure vessel and contacts an entire outer surface of the heat exchanger core, is a production fluid and may comprise water, steam, oil, a thermal fluid (e.g., a thermal oil), or combination thereof. The thermal fluid may comprise water, a C2 to C30 glycol such as ethylene glycol, a unsubstituted or substituted C1 to C30 hydrocarbon such as mineral oil or a halogenated C1 to C30 hydrocarbon wherein the halogenated hydrocarbon may optionally be further substituted, a molten salt such as a molten salt comprising potassium nitrate, sodium nitrate, lithium nitrate, or a combination thereof, a silicone, or a combination thereof. Representative halogenated hydrocarbons include 1,1,1,2-tetrafluoroethane, pentafluoroethane, difluoroethane, 1,3,3,3-tetrafluoropropene, and 2,3,3,3-tetrafluoropropene, e.g., chlorofluorocarbons (CFCs) such as a halogenated fluorocarbon (HFC), a halogenated chlorofluorocarbon (HCFC), a perfluorocarbon (PFC), or a combination thereof. The hydrocarbon may be a substituted or unsubstituted aliphatic hydrocarbon, a substituted or unsubstituted alicyclic hydrocarbon, or a combination thereof. Commercially available examples include Therminol® VP-1, (Solutia Inc.), Diphyl® DT (Bayer A. G.), Dowtherm® A (Dow Chemical) and Therm® S300 (Nippon Steel). The thermal fluid can be formulated from an alkaline organic compound, an inorganic compound, or a combination thereof. Also, the thermal fluid may be used in a diluted form, for example with a concentration ranging from 3 weight percent to 10 weight percent, wherein the concentration is determined based on a weight percent of the non-water contents of the thermal transfer fluid in a total content of the thermal transfer fluid.

An embodiment in which the thermal transfer fluid comprises predominately gaseous products from combustion of natural gas or propane, and further comprises liquid water, steam, or a combination thereof and the production fluid comprises liquid water, steam, a thermal fluid, or a combination thereof is specifically mentioned.

A jet burner is a type of (non-premix) burner combustion system wherein fuel is ejected from one or a plurality of orifices or nozzles, and the lean or partially oxygenated fuel is ignited to produce a flame.

Figure 2:
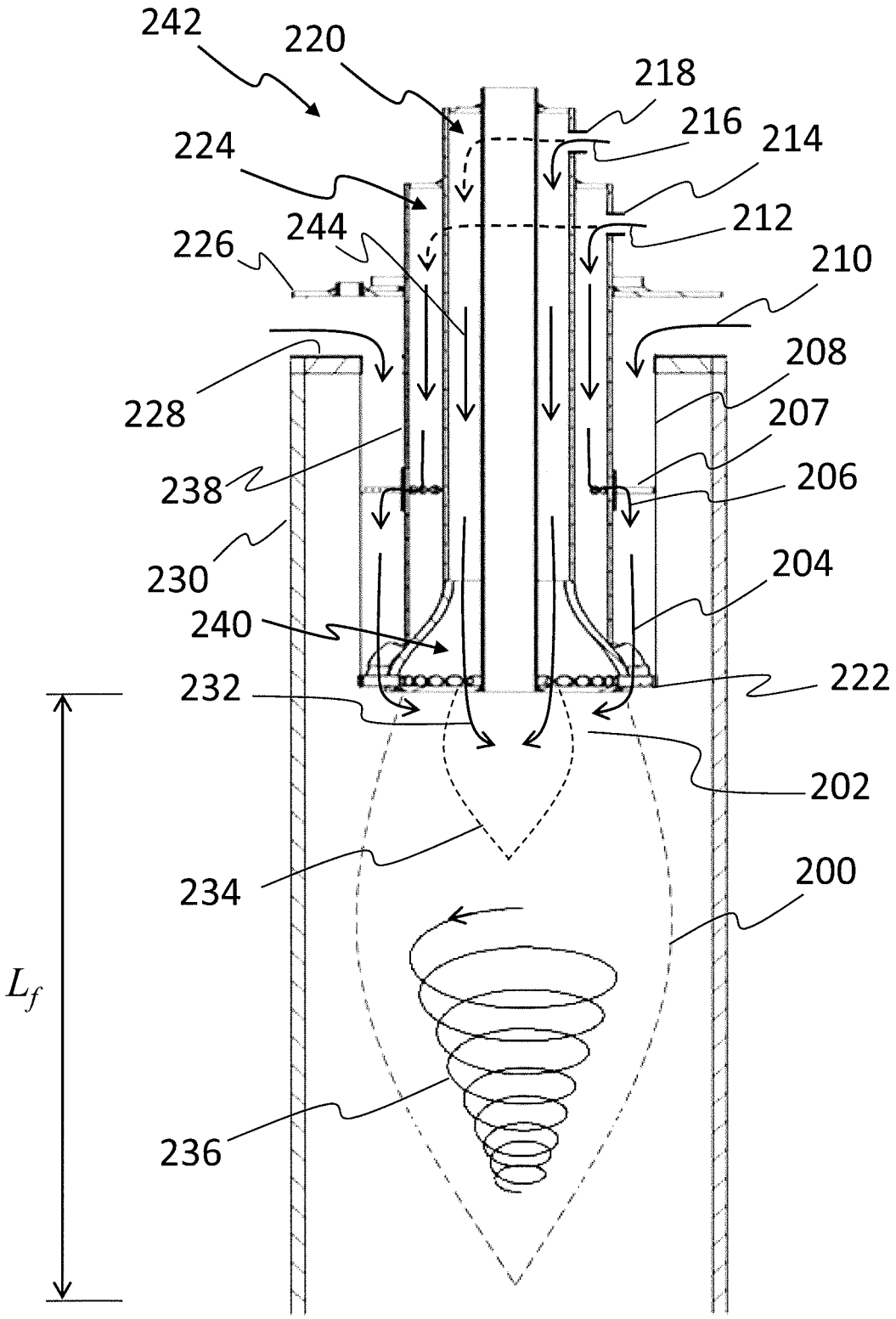
FIG. 2 shows a cross-sectional diagram of an embodiment of a jet burner combustion system in the vertical orientation.

Disclosed in FIG. 2 is an embodiment of a jet burner combustion system 242. Fuel in a primarily vapor state 216 enters an inner annular channel 220 through a conduit 218 and flows 244 under pressure through openings in the burner head 222 into the region 232 of the primary reaction zone 234. Air 210 flows through an opening 226 in the top head 228 under pressure provided by a fan (not shown). The air flows 204 in the space between the inner wall of the blast tube 208 and the outer wall of the burner 238 and through orifices in the burner head 222 into the region supporting the jet flame 200. In this embodiment, a second vapor fuel stream 212 flows through a conduit 214 into an outer annular channel 224. The second fuel stream 206 passes through a series of injectors 207 to be aerated by mixing with the air flow 204, providing a leaner mixture to feed the secondary reaction zone 202 of the flame 200. The rich fuel stream flows into a manifold 240 that provides an increase in flow velocity as the fuel stream passes through openings in the burner head 222. Note that neither the rich primary fuel stream 216 nor the lean aerated secondary fuel stream 212 contain fuel-oxygen mixtures capable of auto-ignition at the temperature and pressure present in inner 220 and outer 224 fuel channels.

The flame 200 produced by the ignited fuel jet stream is a rotating structure 236 and can extend in length $L_f$ a significant distance in the furnace 230 cavity. An example of a jet burner combustion system is the Fulton 40-60 Horsepower LONOX® Burner where the flame may be two-to-four feet (0.6 to 1.2 meters) in length and occupy over half the length of the furnace 230.

Moreover, the jet burner embodiment of FIG. 2 exhibits other undesirable characteristics. First, the velocity of the fuel vapor streaming through orifices in the burner head contributes importantly to the separation distance between the burner head 222 and the flame 200 front. As the vapor velocity decreases, the distances between the flame front and burner head likewise decreases. Extended operation of the burner at a low turndown (ratio between burner maximum power output and low-power operating point)—equivalently, small separation distance between the burner head and flame front—can cause material failures of the components, short mean-time-between-failure (MTBF), and reduced burner lifecycle.

Second, to achieve the higher pressure required at the burner head, both the air stream 210 and the lean 212 and rich 216 fuel flows must be maintained at relatively high pressures. That is, a significant fraction of the fan power used to drive these flows must be expended to overcome the pressure drops from the air 226, lean fuel 214 and rich fuel 218 conduits to the burner head 222 and maintain a relative high flow velocity.

Third, the mixing of the lean fuel 214 and rich fuel 218 flow streams with the air flow 204 is primarily generated by the flow of the fuels through small orifices in the burner head 222. Low turndown ratios consequently imply a reduction in fuel-air mixing, which can increase the production of incomplete combustion byproducts and undesirable emissions (e.g., NOx). Hence, the requirement for higher air and fuel flow velocities imposes limitations on low power operation, durability, lifecycle, maintenance requirements and emission characteristics.

Figure 3:
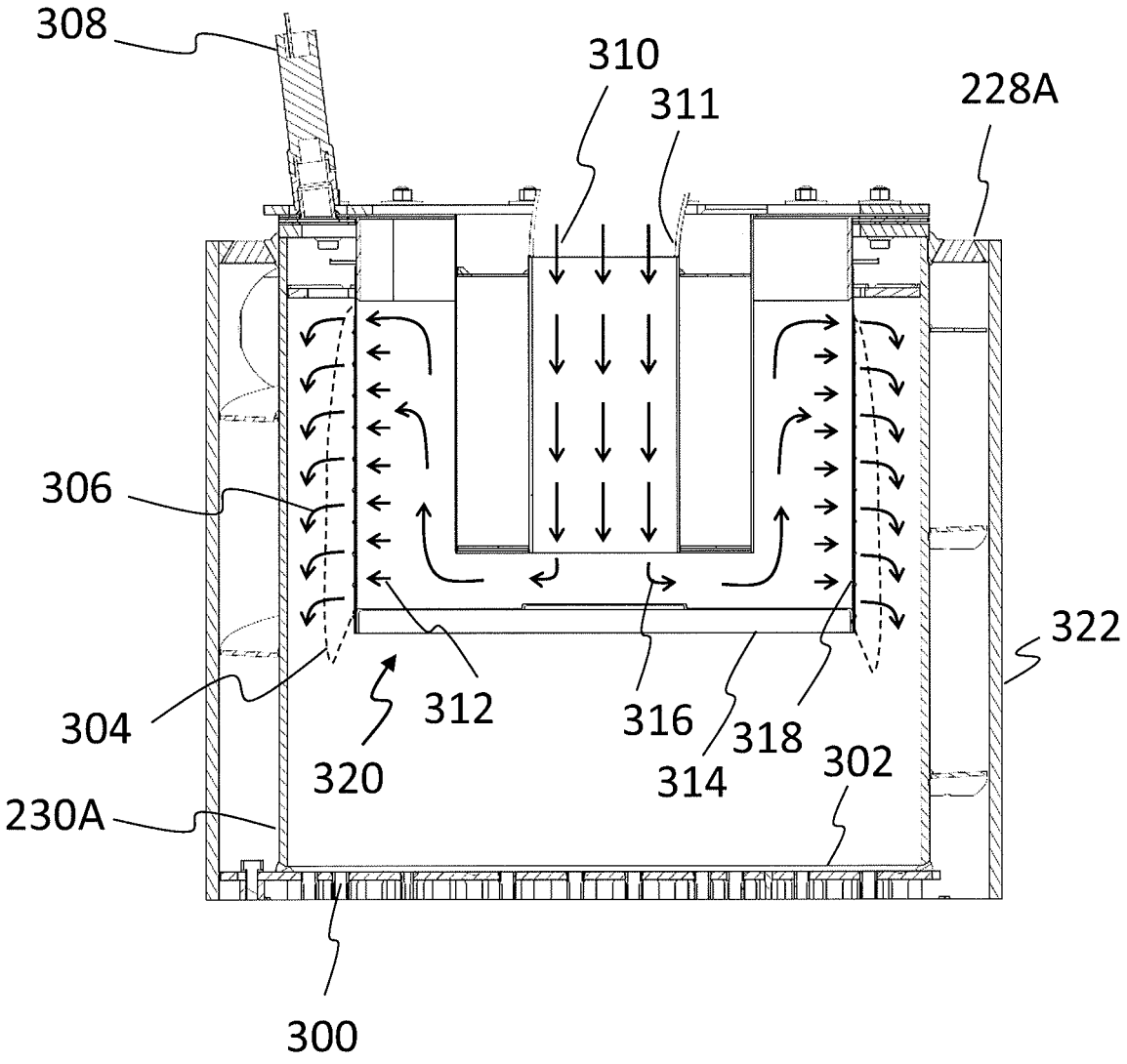
FIG. 3 shows a cross-sectional diagram of an embodiment of a premix burner in the vertical orientation.

The long flame length characteristic of a jet burner flame can be mitigated by using a porous substrate to support the flame, breaking the single long flame structure into many small flames concentrated in a compact region. FIG. 3 shows a cross-sectional schematic of an embodiment of an outward-firing premix burner 320 contained within a furnace 230A. A premixed combination of predominately vapor fuel and air 310 enters the burner inlet 311. In this embodiment the burner has the geometry of a cylindrical annulus, closed at the end distal from the inlet 314. The outer cylindrical combustion substrate 318 is porous and permits the flow of the premixed fuel-air combination. The fuel-air mixture is directed 316 outward along the inner face of the burner cap 314 to the inner region 312 behind of the porous outer burner combustion substrate 318. The premix fuel-air combination passes through the pores in the burner combustion substrate 318 and is ignited to form a dense composite region of flame 304, the flame front hovering over the cylindrical burner combustion substrate by the mass flow 306 of the fuel-air mixture emanating through each of the substrate pores. The resulting flame is typically monitored using a sensor 308 that can detect when the flame is extinguished and/or used as an element in a control system to, for example, modulate the flow rate and/or concentrations of the premix fuel-air mixture.

In a shell- and tube boiler heat exchanger application, the hot combustion products flow into the body of the furnace 230A where they pass through the heat exchanger tubesheet 302 and into the heat exchanger tubes 300. Thermal energy generated by combustion of the premix fuel-air mixture in the region of the composite flame 304 is transferred across the thin walls of the heat exchanger tubes 300 to the production fluid inside the pressure vessel 322 sealed at one end to the furnace by the top head 228A.

One disadvantage to the outward firing geometry is that the composite flame region 304 and hot combustion products 306 can impinge upon the inner surface of the furnace 230A, depending upon the fuel-air mass flow through the pores, the dimensions of the space between the burner combustion substrate 318 and the inner furnace wall 203A. Furthermore, the geometry of outward firing burners removes a substantial volume from the furnace cavity, reducing the volume available for combustion. As a result of the reduced volume, incomplete combustion occurs which lowers efficiency and increases the production of incomplete combustion products, including environmental contaminates.

Figure 4:
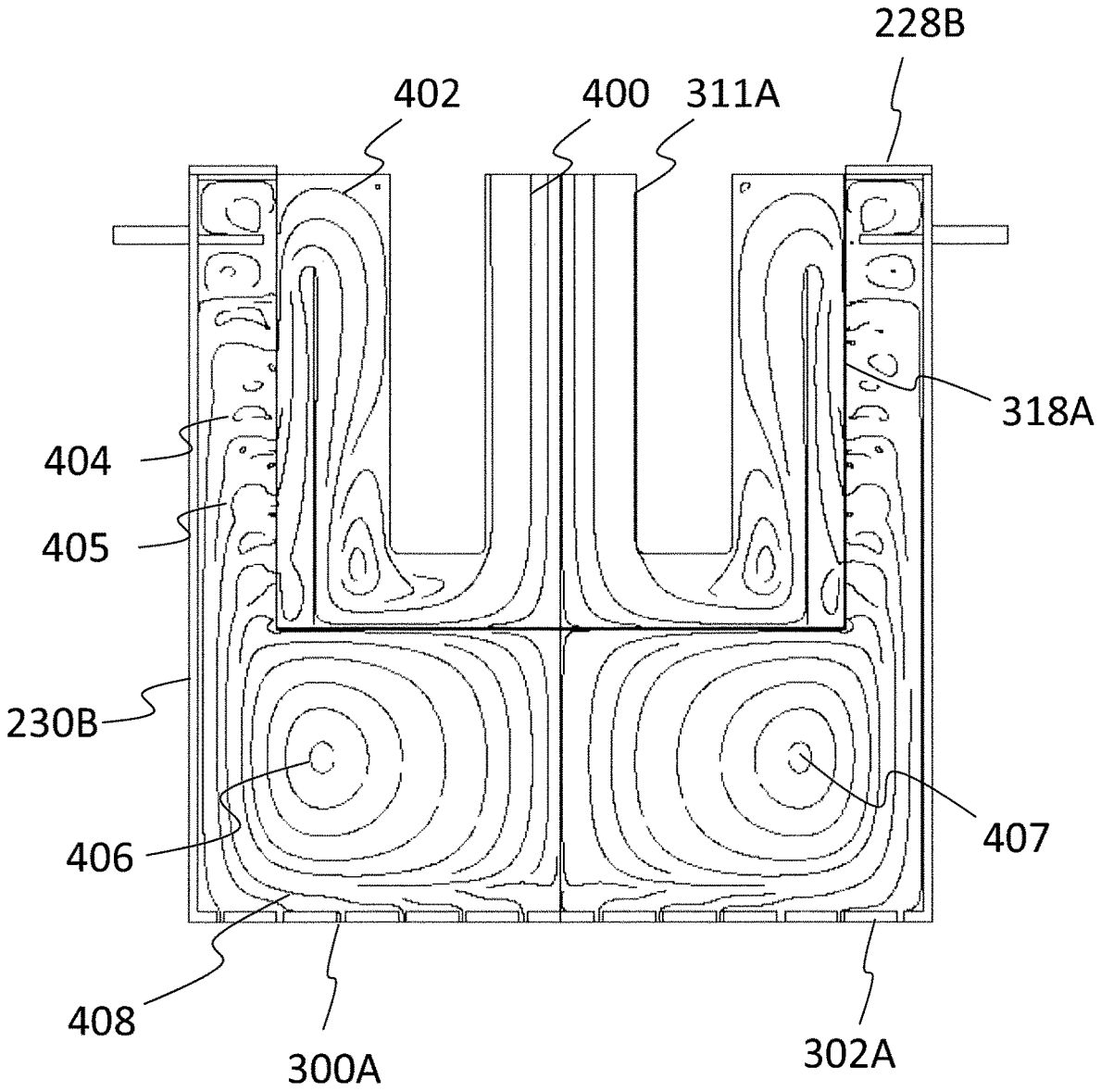
FIG. 4 shows a cross-section of calculated streamlines for a simulated flow in an embodiment of an outward-firing burner combustion system in the vertical orientation in accordance with embodiments of the present disclosure.

Moreover, the flow of hot combustion products is guided by the relative geometry of the burner combustion substrate 318 and the furnace 230A cavity. FIG. 4 shows streamlines generated by a computational fluid dynamic (CFD) model simulation of the burner geometry shown in FIG. 2, and illustrates some of the flow challenges. The premix fuel-air mixture flows 400 into the burner inlet 311A, through the burner interior 402 sealed by the top head 228B and is directed through the pores in the cylindrical burner combustion substrate 318A. In this outward-firing arrangement, the fuel-air mixture is directed outward through the combustion where it is ignited 404 in the region of high temperature. The combustion products flow 405 in the restricted space between the cylindrical burner combustion substrate 318A and the inner furnace wall 230B. Due to the geometrical cavity constraints, the flow may form a vortex 406 where the flow can be stagnant 407. Moreover, the flow streamlines 408 traversing radially from the edge of the tubesheet 302A towards the center creates a large temperature gradient across the face of the tubesheet, so that heat exchanger tube openings 300A at the circumference of the tubesheet receive flow at a lower average temperature than heat exchanger tubes located closer to the center.

Figure 5:
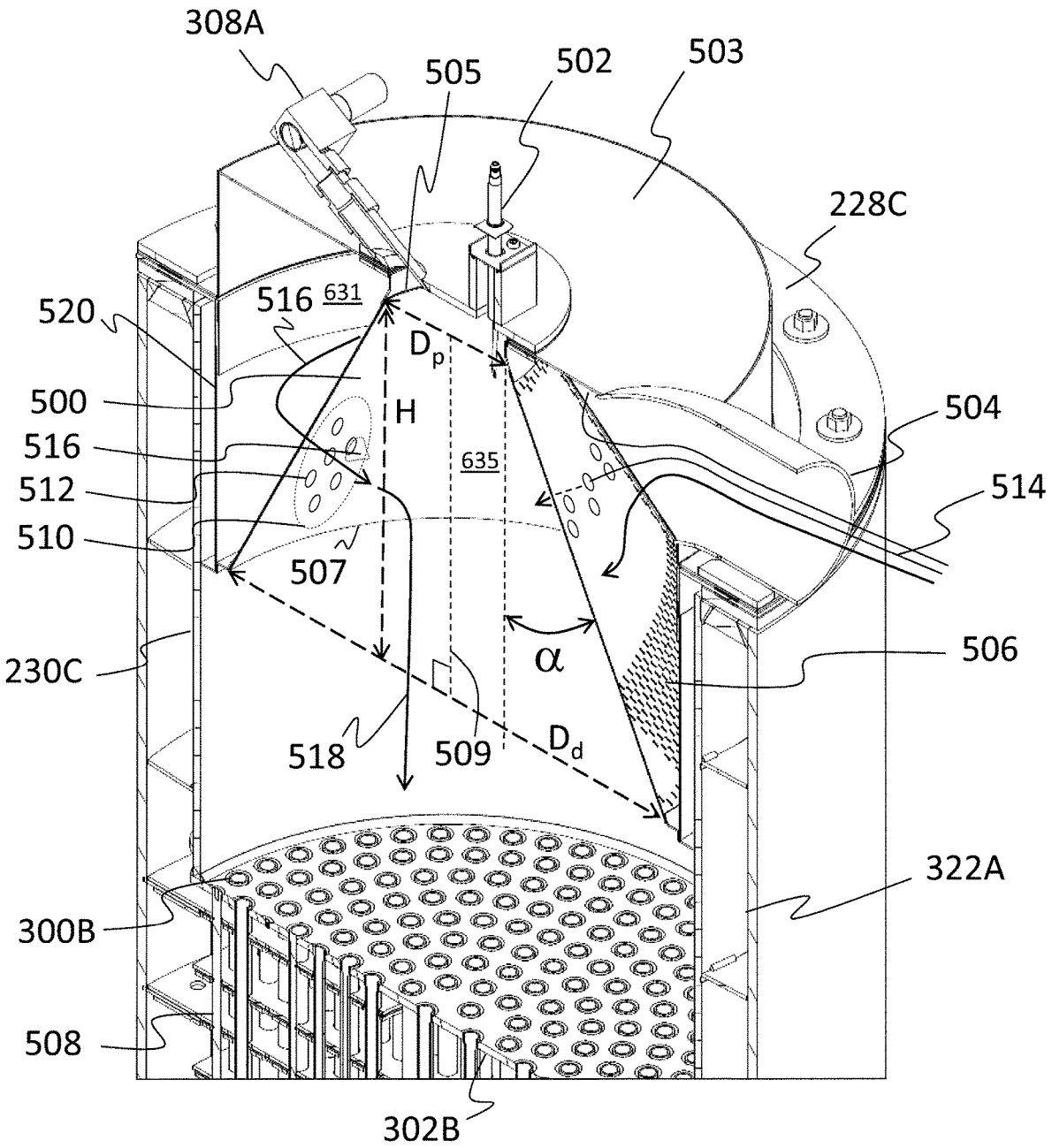
FIG. 5 shows a cutaway diagram of an embodiment of a premix combustion system with a single semi-conical combustion substrate in accordance with embodiments of the present disclosure.

The inventors have unexpectedly discovered that an inward-firing burner geometry alleviates many of the disadvantages described above. FIG. 5 shows a cutaway diagram of an embodiment of an inward-firing premix burner comprising a semi-cone combustion substrate, although some advantages of inward-firing premix burner embodiments discovered by the inventors are not limited to the composite semi-cone geometry. A semi-cone shaped combustion substrate 500 is disposed between the burner top head 503 and the inner surface of the furnace 230C. In this embodiment, the burner combustion substrate is a right circular frustum wherein the proximal edge 505 is a planar circle perpendicular to a longitudinal (or axial) axis 509 with proximate diameter $D_p$ and distal edge 507 a planar circle perpendicular to the longitudinal axis 509 with distal diameter $D_d$, with height H. The burner combustion substrate angle α in a right frustum embodiment is then determined to be:

$$\alpha=\arctan[(D_d-D_p)/H] \quad \text{Eq. 1}$$

Dimensions of the combustion substrate depend upon the burner power, capacity, performance and size requirements of a specific application. Proximal diameters ($D_r$) between 1 inch and 59 inches is specifically mentioned. Distal diameters (Dd) between 2 inches and 60 inches is specifically mentioned. Substrate height (H) between 1 inch and 60 inches is specifically mentioned.

The semi-cone sections of the burner combustion substrate angle may have any suitable generator angle between 1 degree, 2 degrees, 3 degrees, 4 degrees, 5 degrees, 10 degrees to 11 degrees, 12 degrees, 13 degrees, 14 degrees, 15 degrees, 16 degrees, 17 degrees, 18 degrees, 19 degrees, 20 degrees, 21 degrees, 22 degrees, 23 degrees, 24 degrees, 25 degrees, 26 degrees, 27 degrees, 28 degrees, 29 degrees, 30 degrees, 31 degrees, 32 degrees, 33 degrees, 34 degrees, 35 degrees, 36 degrees, 37 degrees, 38 degrees, 39 degrees, 40 degrees, 50 degrees, 60 degrees, 70 degrees, 80 degrees, 85 degrees, and 90 degrees wherein the foregoing upper and lower bounds can be independently combined. For the right circular semi-cone, right circular truncated cone, and the right circular frustum, the burner combustion substrate angles between 18 degrees and 35 degrees is specifically mentioned. For the right circular semi-cone, right circular truncated cone, and the right circular frustum, the burner combustion substrate angle of 25 degrees is also specifically mentioned.

In some embodiments, a burner combustion substrate angle α may be 90 degrees which corresponds to a flat structure, surface, plate, disk or annulus, which may be viewed as a degenerate semi-cone that is the limit of a family of semi-cones with circumference diameter, $D_d$. For the right circular semi-cone, right circular truncated cone, and the right circular frustum, the burner combustion substrate angle α=90 degrees is specifically mentioned.

The burner combustion substrate is porous to the flow of premix fuel-air mixtures predominately in a vapor state. Substrate pores 506 are distributed over the area of the burner combustion substrate to support a flame front in the burner combustion cavity 635 near the interior surface. (The pore 512 size in a local area 510 are exaggerated in the diagram for clarity and are not meant to be to scale.) The combustion process may be monitored by a sensor 308A which can detect if the flame is extinguished.

In the embodiment shown a premix(ed) fuel-air mixture 514 enters the inlet 504 of the burner and flows within a burner pre-combustion cavity 631 and around and through the burner combustion substrate 500 inward toward the longitudinal (or axial) axis 509. The fuel-air mixture ratio is arranged so that the premix fuel is ignited near the interior surface to form a flame structure suspended over the interior surface of the burner combustion substrate, within a burner combustion cavity 635.

The flame structure may comprise individual flamelets—relatively small, distinct and stable laminar regions of combustion—which may merge at higher combustion production conditions and may form a flame front suspended a predetermined distance the substrate as described below.

In a boiler application comprising a shell and tube heat exchanger, the combustion products (e.g., hot gases, particulate byproducts) flow 518 towards the tubesheet 302B where they pass through the openings 300B of the heat exchanger tubes 508. Heat generated by the combustion process is transferred across the walls of the heat exchanger tubes 508 to production fluid occupying the space between the outer surfaces of the furnace 230C and heat exchanger tubes 508 and the inner surface of the pressure vessel 322A, sealed at one end by the boiler top head 228C.

Figure 6A:
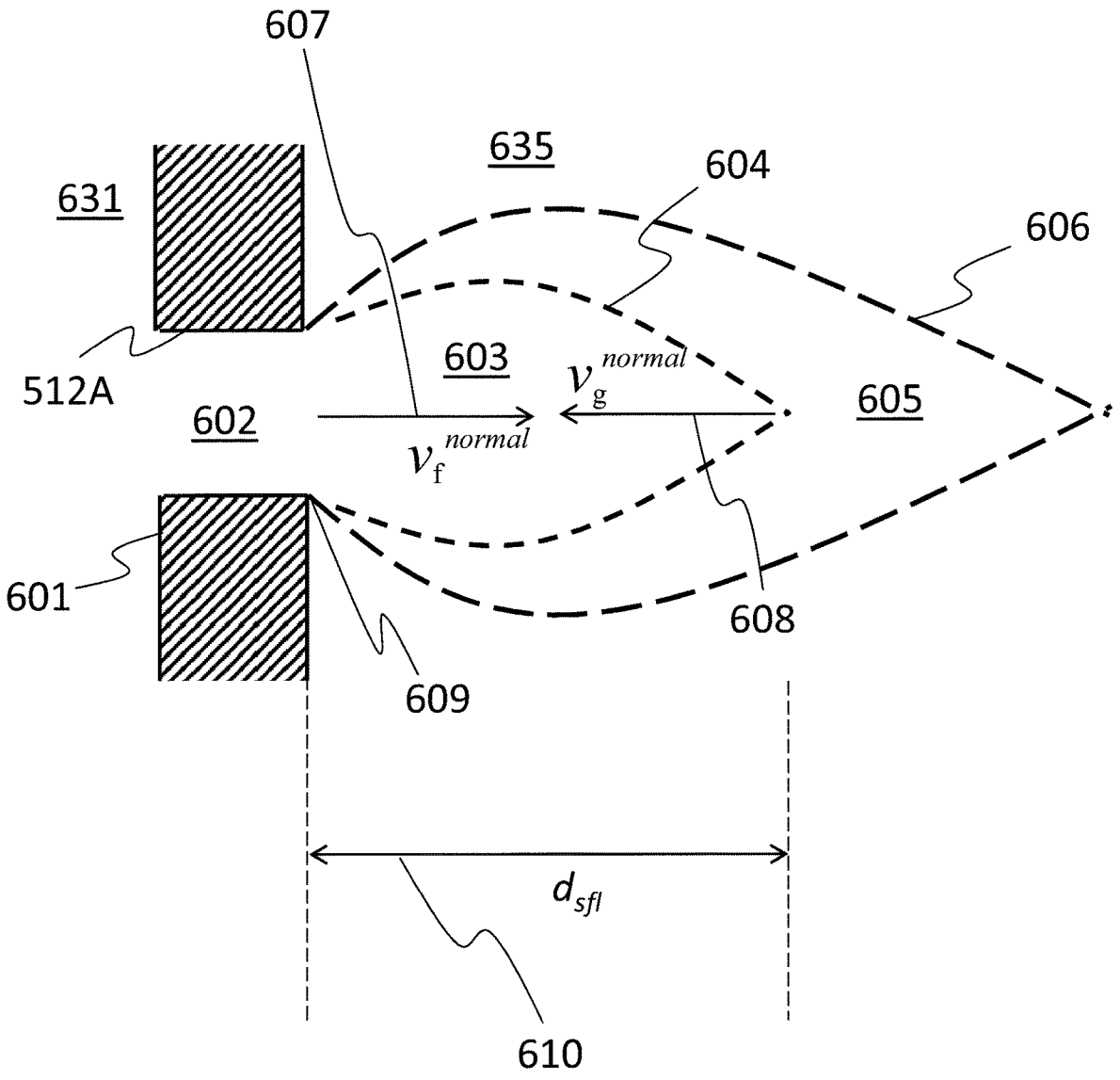
FIG. 6A shows an illustration of the velocity vectors comprising the calculation of the combustion flame equilibrium ratio (p) in the region between a porous combustion substrate and a flamelet in accordance with embodiments of the present disclosure.

Without being bound by theory, the burner combustion substrate provides a physical structure to support the flame front generated when the premix fuel-air mixture is ignited, and the porosity of the substrate determines certain aspects of the resulting combustion process as illustrated in FIG. 6A which shows a region around a single pore 512A bounded by a cross-section view of the porous substrate 601. The premix fuel-air mixture is directed from an outside through the pore space bounded by the pore 512A perforation walls to an inside of the burner substrate above the pore opening called the preheating zone 603. Note that in normal operation the premix fuel-air mixture is below the autoignition temperature of the fuel premix in the interior of the pore 602 and the preheating zone 603. As the premix fuel-air mixture is carried by the flow momentum with velocity $v_f^{normal}$ 607 towards the interior of the burner, the temperature rises until it exceeds the autoignition temperature of the premix fuel-air mixture and it ignites in the reaction zone 605. During stable combustion the preheating zone 603 and the reaction zone share a combustion interface 604 that forms a persistent coherent structure. (Persistent and coherent in the sense that the preheating zone 603, reaction zone 605 and the combustion interface—while not fixed structures—are also not transient structures, but persistent, recognizable and stable in a relatively long time-average sense with orderly components that exhibit stochastically stable properties.) The premix fuel-air mixture combustion primarily occurs in the reaction zone bounded releasing heat, gaseous and particulate byproducts into the burner.

The tendency for the reaction zone to consume the premix fuel-air mixture creates a force toward the pore that tends to move the combustion interface 604 near its apex over the pore with a velocity $v_g^{normal}$ 608. Thus, these two opposing forces balance at a condition where the flame equilibrium ratio number:

$$1 < \rho = \frac{|v_f^{normal}|}{|v_g^{normal}|} \lessapprox 100 \quad \text{Eq. 2}$$

where, in a time-average sense and the right inequality means "less than approximately", denoting the fact that the upper bound has been empirically determined by practical examples and should not be construed to limit or constrain the interpretation of the claims. Other embodiments may possess practical upper bounds that are higher or lower when designed by those skilled in the art. That is, an important design characteristic is to select burner substrate construction, porosity and operation conditions that ensures the flame reaction zone remains approximately stationary relative to the pore opening suspended at a distance from the pore.

For certain combinations of pore geometry, which may be referred to herein as the "suspended flamelet" or "suspended flame" state, premix flow rate and operating conditions, the preheating zone 603, combustion interface 604 and reaction zone 605 remain attached 609 to edges of the pore 512A, forming a stable, persistent structure called a flamelet anchored to the interior surface of the burner substrate 601. Because the flamelet's preheating zone 603 contains uncombusted fuel-air mixture, it is relatively cool compares to the reaction zone 605. That is, the preheating zone 603 serves to insulate the substrate from the high temperature of the reaction zone 605. This is a desirable condition since it allows for high burner heat production capacity while simultaneously maintaining cooler temperatures at the burner substrate surface that promotes longevity of the substrate and reduces the likelihood of material failure. The separation of the reaction zone 605 from the substrate 601 inner surface that promotes this insulative effect can be expressed—in a local sense—as the flamelet separation distance, $d_{SFL}$, 610 from the inner surface of the substrate 601 over the pore 512A and the apex of the combustion interface 604. In practice, flamelet separation distances for premixtures of natural gas and air are between zero (0) inches (surface combustion) and approximately 1.75 inches (suspended flame combustion, SF), although the distance will vary (stochastically and as an average distance observed over relatively long time periods) in practice. In some embodiments, the flamelets may overlap depending on the distance between pores, flow rate, and other conditions.

Figure 6B:
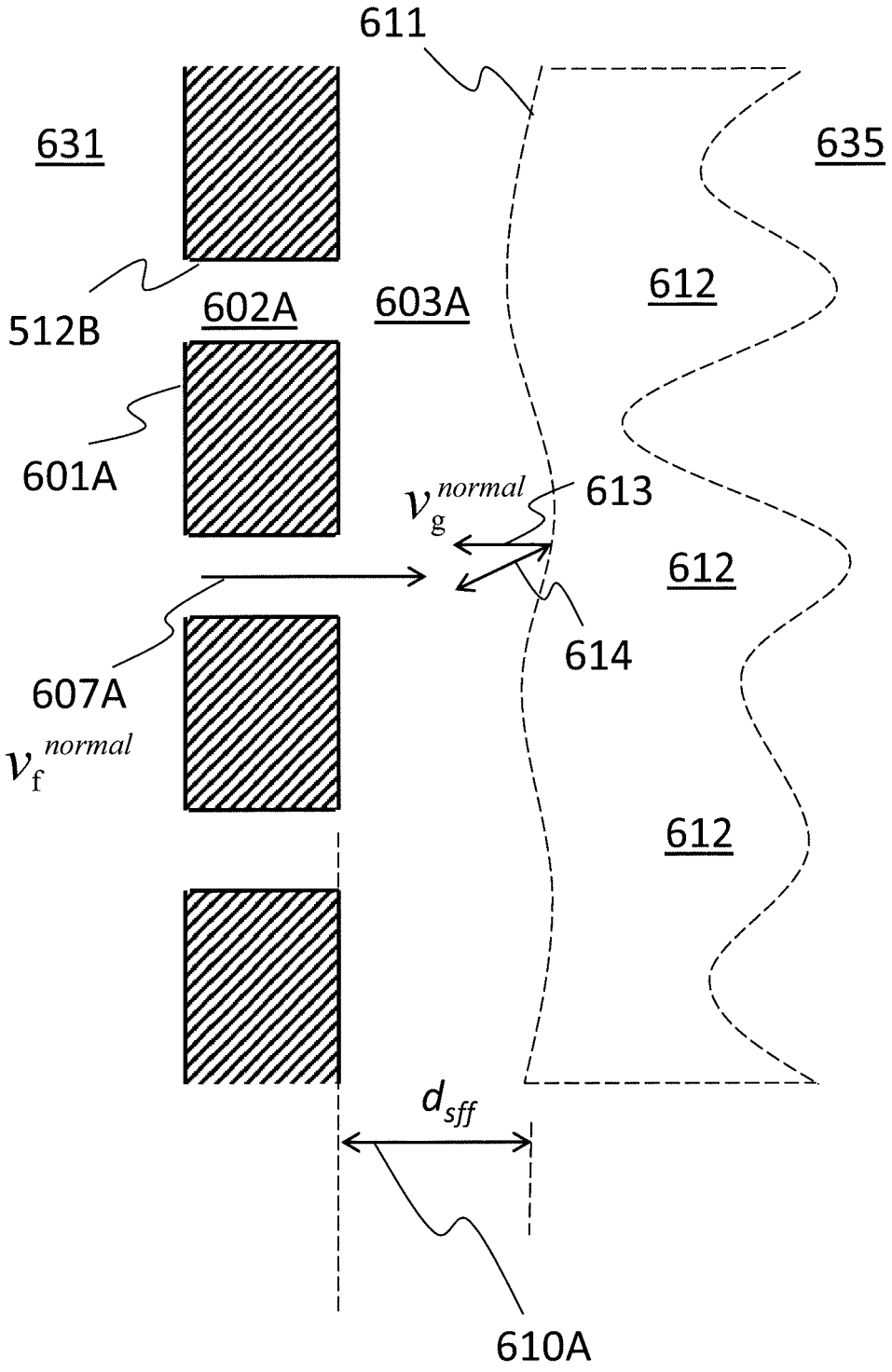
FIG. 6B shows an illustration of the velocity vectors comprising the calculation of the combustion flame equilibrium ratio (p) in the region between a porous combustion substrate and a flame front in accordance with embodiments of the present disclosure.

Under certain operating conditions, which may be referred to herein as the "suspended flame front" state, particularly when the premix fuel-air mixture flow velocity is high, the flamelets may detach from the inner surface of the burner substrate, as illustrated in the embodiment shown in FIG. 6B. Under such conditions, the flamelets may coalesce into a new coherent combustion characterized by a flame front 611 suspended over a collection of pores 512B. The flame front formed by separating a layer of uncombusted premix fuel-air mixture 603A flowing through the interior pore space 602A of the pore 512B into a preheating zone beneath a coalesced reaction zone 612 undergoing primarily volume combustion typical of a cavity burner. Under narrow operating conditions, this coherent structure may maintain a relatively fixed position suspended over a collection of pores, separated by a suspended flame front distance, $d_{SFF}$, 610A from the inner surface of the burner substrate 601A when a balance of forces exists between the premix fuel-air mixture with velocity $v_f^{normal}$ 607A and the opposing force of the flame front's 611 motion towards the inner surface of the burner substrate 601A with opposing velocity $v_g^{normal}$ 613. Note that because the flame front is typically not anchored to the surface of the substrate, the velocity of the flame front may have a non-normal component 614 which may tend to shift the position of the reaction zone in time and space. The suspended flame front state is typically a transient or unstable state, and thus is not typically operated in for sustained operation.

The conditions or states described herein with FIGS. 6A and 6B may be referred to collectively herein as the "suspended flame combustion" or SF combustion, as described hereinbefore.

These principles have been verified using an experimental test apparatus. Based on experimental data, Table 1 shows typical geometry and operating conditions that will exhibit suspended flame (SF) combustion in a burner using a semi-cone substrate geometry.

TABLE 1

| Parameter | Description and Values |
|---|---|
| Plate Material | 439 Stainless Steel |
| Plate Thickness | 20 GA, 0.9525 mm |
| Pore Type & Dimensions | Slots 1 mm × 6 mm dimensions. Pore Area = 5.79 $mm^2$ |
| Number of Slots | 1,834 |
| Flow Mean Velocity | 1.2 m/s to 27 m/s tested |
| Flow Port Loading | 3.69 $W/mm^2$ to 82.93 $W/mm^2$ |
| Burner Input | 879765.4 W |
| Cone Area | 84,424.2 $mm^2$ |
| $D_p$ | 354 mm |
| $D_d$ | 472 mm |
| Height | 25.4 mm |

Porosity of the burner combustion substrate can be achieved by a number of constructive means, so long as they equivalently achieve and maintain the semi-conical shape and porosity characteristics required by a specific set of design parameters. Perforations in a solid substrate, including perforations in a metal sheet, are specifically mentioned.

Figure 6C:
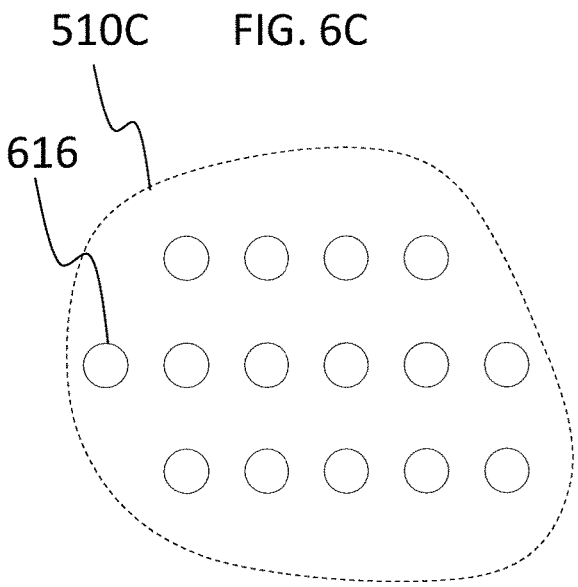
FIG. 6C shows an illustration of the symmetric pores arranged in a regular distribution in a section of a porous combustion substrate in accordance with embodiments of the present disclosure.
Figure 6D:
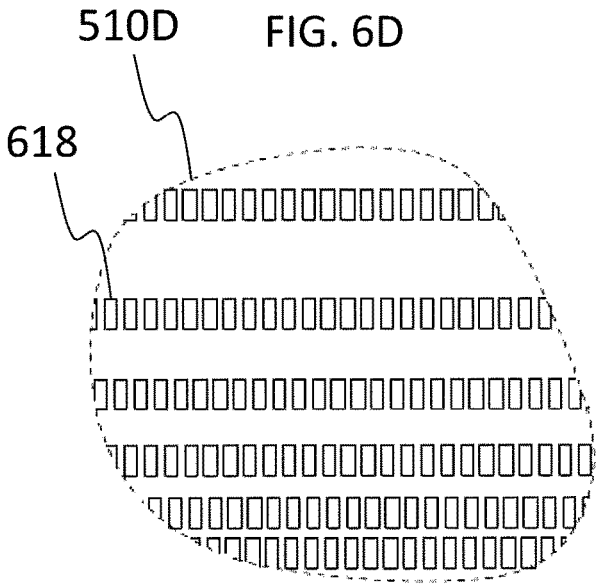
FIG. 6D shows an illustration of the circular pores arranged distributed in a section of a porous combustion substrate in accordance with embodiments of the present disclosure.
Figure 6E:
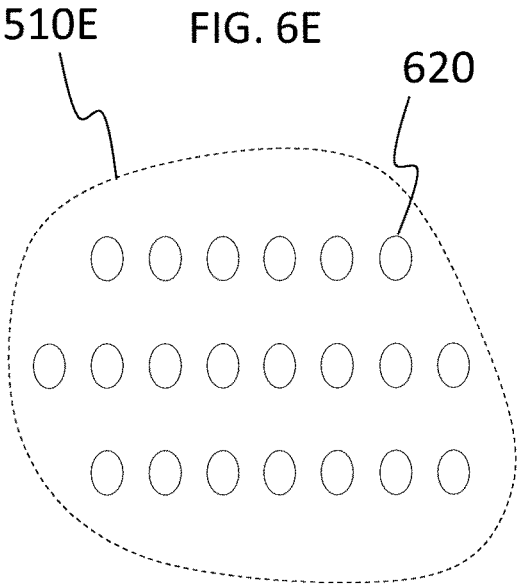
FIG. 6E shows an illustration of non-circular pores arranged in a regular distribution in a section of a porous combustion substrate in accordance with embodiments of the present disclosure.
Figure 6F:
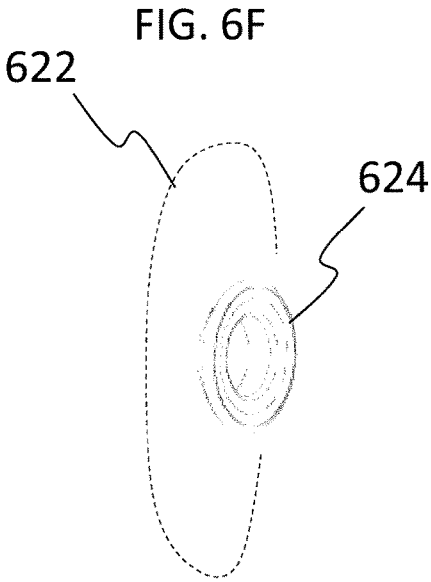
FIG. 6F shows an illustration of an embodiment of a three-dimensional structure for a pore of a porous combustion substrate in accordance with embodiments of the present disclosure.

The pore 2-dimensional and 3-dimensional structure, together with the distribution of pores in the burner combustion substrate, are designed in concert to achieve an operational flame structure required to meet the specifications a particular application. FIG. 6C shows a uniform distribution of circular perforations 616 in a local region 510C of a solid continuous burner combustion substrate. The pores 618 may be non-circular, as shown in FIG. 6D, and non-uniformly distributed on the burner combustion substrate. The porosity may result from perforations in a continuous surface; other equivalent embodiments are possible and known to those skilled in the art. FIG. 6E shows a local region 510E of porous substrate wherein the pore 620 shape is unsymmetrical. Finally, some or all of the burner combustion substrate pores 624 may have a 3-dimensional structure in a region 622 of the substrate designed to promote certain flow or flame characteristics. A pore with the 3-D shape of a nozzle is specifically mentioned.

Figure 6G:
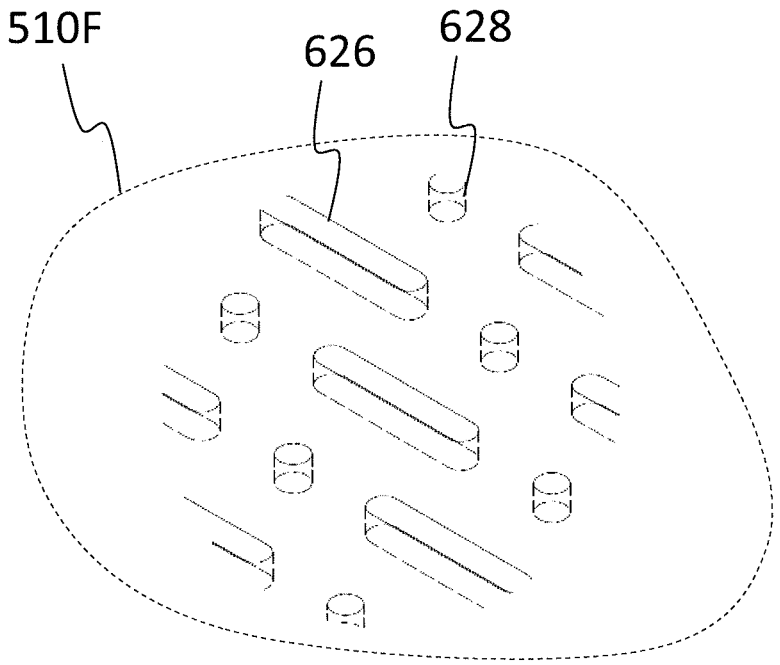
FIG. 6G shows an illustration of circular holes and slots arranged in a regular distribution in a section of a porous combustion substrate in accordance with embodiments of the present disclosure.

The shapes and distributions of pores can be mixed to produce desirable heat production, pressure drop across the cross-section of the substrate and combustion stability properties as illustrated by the embodiment shown in FIG. 6G. For a region 510F of the burner substrate porosity is generated by a regular pattern of slots 626 and holes 628 perforated in the substrate surface. Without being bound by theory, distributions of narrow slots 626 and holes 628 with small diameter tend to promote combustion stability, but increase the pressure drop across cross-section of the burner substrate by presenting a high resistance to the premix fuel-air flow. Wider slots 626 and holes 628 with large diameters decrease the pressure drop due to flow resistance, but may increase the tendency of flame blow-out, flashback and resonance instabilities. Empirically, the inventors have found that circular hole diameters between 0.5 millimeters and 2 millimeters and slots with width dimensions between 0.5 millimeters and 2 millimeters and length dimensions between 2 millimeters and 15 millimeters provide a practical balance of flow and stability characteristics. A circular hole diameter of 1 millimeter is specifically mentioned. A slot with width 1 millimeter and length of 6 millimeter is specifically mentioned. A regular pattern of holes, slots, or holes and slots promotes manufacturability, but the present disclosure is meant to encompass all regular and irregular patterns of holes or slots or holes and slots in combination with approximately equivalent premix fuel-air flow and combustion properties. The substrate temperature and pressure drop is also affected by the fraction of the burner substrate surface that is perforated to produce pores. Empirical results show that a perforated surface area of between approximately 5 percent, 6 percent, 7 percent, 8 percent, 9 percent or 10 percent of the total substrate surface area to approximately 20 percent, 22 percent, 24 percent, 26 percent, 28 percent, 30 percent, 32 percent, 34 percent, or 36 percent of the total substrate surface area provides practical control of the substrate surface temperature wherein the foregoing upper and lower bounds can be independently combined. The range 8 percent to 20 percent of the total substrate surface area is specifically mentioned.

There are several important advantages to the arrangements in the disclosed embodiments. A first feature is that—depending upon the specific parametric choices for design parameters (including pore size and density, the fuel-air flow velocity and combustion substrate geometry)—while the burner can be operated in a range of combustion modes from surface combustion to volume combustion, the geometry is suitable for stable suspended flame (SF) combustion applications. This is desirable since the resulting separation distance between the flame front and the combustion substrate in SFF combustion: (a) relaxes the material demands on the substrate in the presence of high temperatures during operation, eliminating the need for insulation of the substrate; and, (b) reduces the risk of substrate material failure or contamination of the pores by combustion byproducts.

Figure 6H:
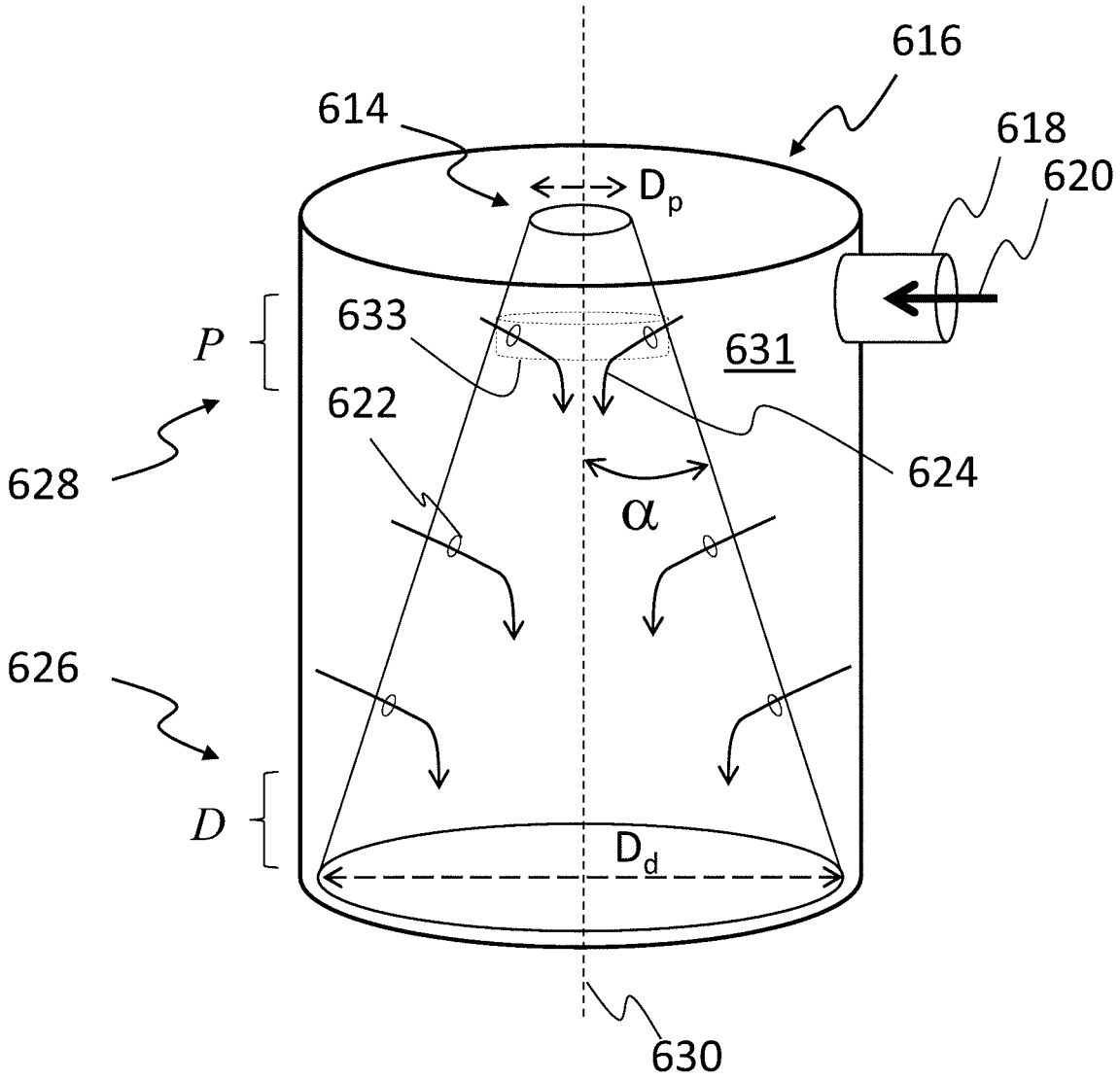
FIG. 6H shows a perspective drawing of the premix fuel-air flow field in the burner through the pores of a semi-cone substrate with an acute substrate angle in accordance with embodiments of the present disclosure.

A second feature is that the semi-cone combustion substrate geometry promotes substantial uniformity of the combustion process over the entire interior surface of the substrate. FIG. 6H presents a perspective drawing showing a burner combustion system 616 comprising a semi-cone shaped combustion substrate 614. A premix fuel-air mixture 620 enters the burner casing 520 through the inlet conduit 618 and is distributed by the flow geometry in the annular region formed between the burner casing and the substrate. The mass flow of fuel-air mixture in a circumferential section 633 of the semi-cone combustion substrate is determined by the flow rate 624 through the distribution of pores 622 and the surface area of the substrate at that altitude of the semi-cone. At the proximal end 628 of the combustion substrate, P, the fuel-air flow rate is relatively high and the circumferential section surface area is low. Conversely, at the distal end 626 of the combustion substrate, D, the fuel-air flow rate is relatively low and the circumferential section surface area is high. The volume of the burner casing 616, the proximal ($D_p$) and distal ($D_d$) diameters of the semi-cone combustion substrate and the semi-cone angle, $\alpha$, as measured from the axis 630 can be selected so that the fuel-air mass flow is substantially uniform along the entire length of the substrate. Balancing the local fuel-air mass flow to achieve a substantially uniform distribution of fuel-air mass flow into the flame front (and, therefore, heat generation, temperature, flow velocity, etc.) is a feature that distinguishes the embodiments comprising a semi-cone combustion substrate from other alternatives.

Moreover, the burner combustion substrate defines a combustion volume delineated by the interior surface of the substrate that is optimized for improved and complete combustion of the premix fuel-air mixture, homogeneous distribution of the flame front on the interior surface of the porous substrate (equivalently, diffuser), and substantial uniformity of the resulting flow field of combustion products.

Figure 6I:
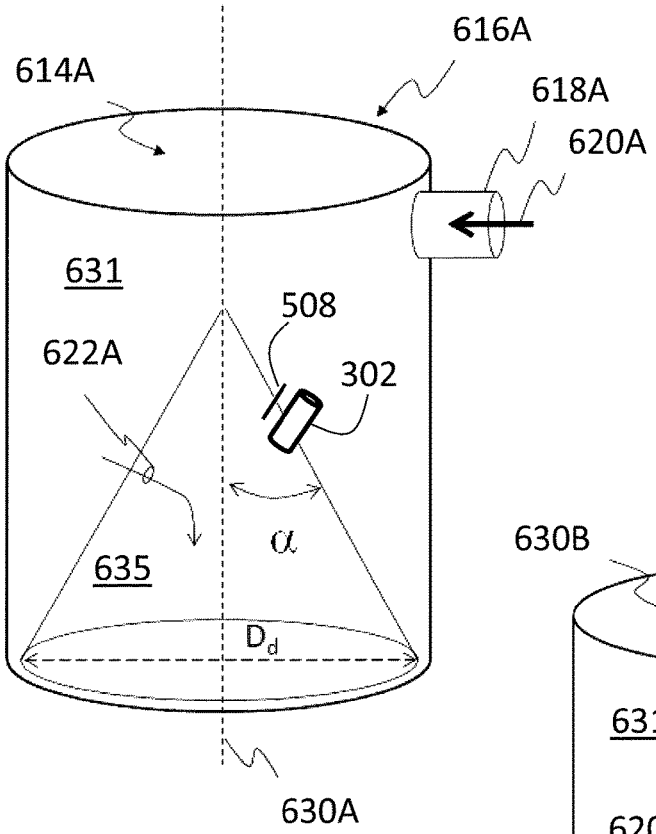
FIG. 6I shows a perspective drawing of the premix fuel-air flow field in the burner through the pores of a semi-cone substrate with an acute substrate angle and proximal diameter equal to zero in accordance with embodiments of the present disclosure.

The desirable flow field and temperature distribution properties persist for a range of semi-cone burner substrate geometries. FIG. 6I illustrates an embodiment that shows a perspective drawing of a burner 616A comprising a semi-cone shaped combustion substrate 614A with an acute, non-zero substrate angle and proximal diameter equal to zero. A premix fuel-air mixture 620A enters the burner casing through the inlet conduit 618A and is distributed by the flow geometry to the annular burner pre-combustion cavity 631 formed between the burner casing and the substrate. The mass flow of fuel-air mixture in a circumferential section of the semi-cone combustion substrate is determined by the flow rate through the distribution of pores 622A and the surface area of the substrate at that altitude of the semi-cone. The premix fuel-air flows through the pores of a semi-cone substrate which ignites within the burner combustion cavity 635, as described herein. Also shown are the igniter 508 and the detector sensor 308A disposed on the substrate in a location away from the axis centerline.

Figure 6J:
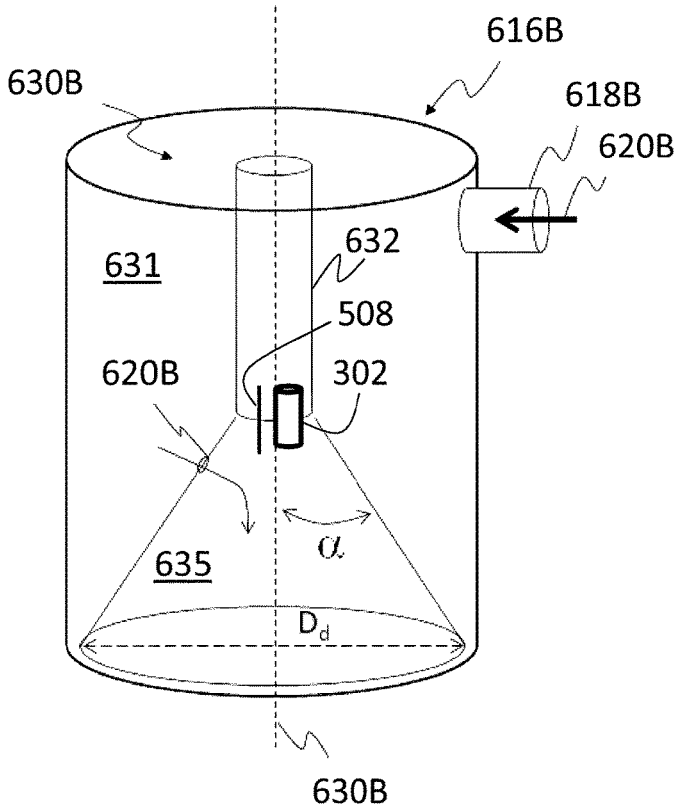
FIG. 6J shows a perspective drawing of the premix fuel-air flow field in the burner through the pores of a semi-cone substrate with an acute substrate angle and an instrument conduit between the proximal end of the substrate and the burner head in accordance with embodiments of the present disclosure.

FIG. 6J illustrates an embodiment that shows a perspective drawing of a burner 616B comprising a semi-cone shaped combustion substrate 614B with an acute, non-zero substrate angle. A premix fuel-air mixture 620B enters the burner casing through the inlet conduit 618B and is distributed by the flow geometry to the annular burner pre-combustion cavity 631 formed between the burner casing and the substrate. The mass flow of fuel-air mixture in a circumferential section of the semi-cone combustion substrate is determined by the flow rate through the distribution of pores 622B and the surface area of the substrate at that altitude of the semi-cone. The premix fuel-air flows through the pores of the semi-cone substrate which ignites within the burner combustion cavity 635, as described herein. Also shown are the igniter 508 and the detector sensor 308B disposed on the substrate in a location on the axis centerline through a conduit 632 to the burner head.

Figure 6K:
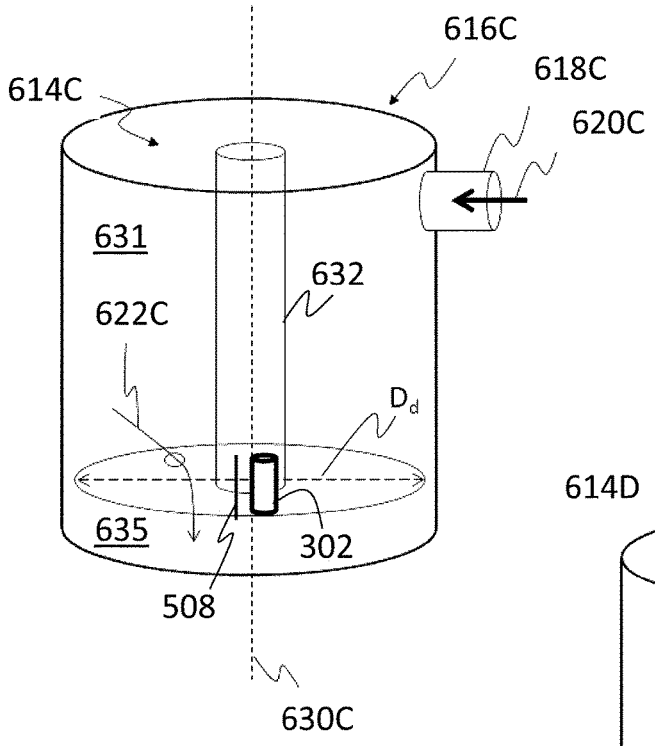
FIG. 6K shows a perspective drawing of the premix fuel-air flow field in the burner through the pores of a semi-cone substrate with substrate angle equal to zero and an instrument conduit between the center of the substrate and the burner head in accordance with embodiments of the present disclosure.

FIG. 6K illustrates an embodiment that shows a perspective drawing of a burner 616C comprising a semi-cone shaped combustion substrate 614C with substrate angle equal to zero. A premix fuel-air mixture 620C enters the burner casing through the inlet conduit 618C and is distributed by the flow geometry in the burner pre-combustion cavity 631 formed between the burner casing and the substrate. The mass flow of fuel-air mixture is determined by the flow rate through the distribution of pores 622C and the surface area. Also shown are the igniter 508 and the detector sensor 308C disposed on the substrate in a location on the axis centerline through a conduit 632 to the burner head.

Figure 6L:
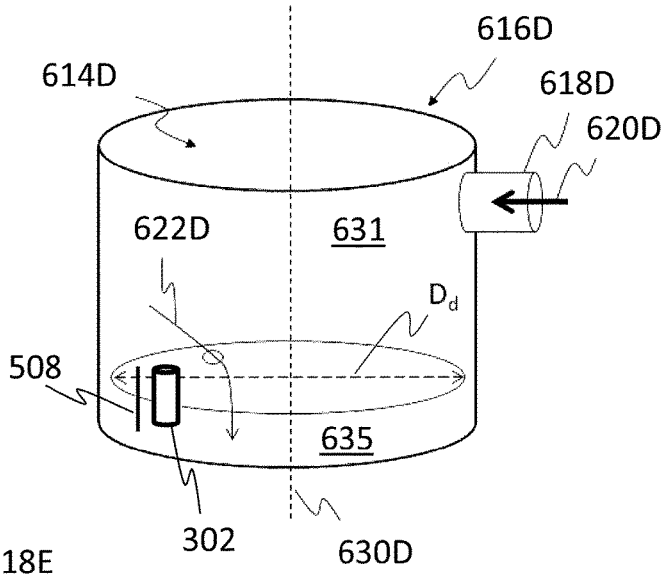
FIG. 6L shows a perspective drawing of the premix fuel-air flow field in the burner through the pores of a semi-cone substrate with substrate angle equal to zero and an instrument package near the circumference of the substrate in accordance with embodiments of the present disclosure.

FIG. 6L illustrates an embodiment that shows a perspective drawing of a burner 616D comprising a semi-cone shaped combustion substrate 614D with substrate angle equal to zero (i.e., flat plate). A premix fuel-air mixture 620D enters the burner casing through the inlet conduit 618D and is distributed by the flow geometry in the region formed between the burner casing and the substrate. The mass flow of fuel-air mixture is determined by the flow rate through the distribution of pores 622D and the surface area, and combustion occurs within the burner combustion cavity 635, as described herein. Also shown are the igniter 508 and the detector sensor 308D disposed on the substrate in a location away from the axis centerline.

Figure 6M:
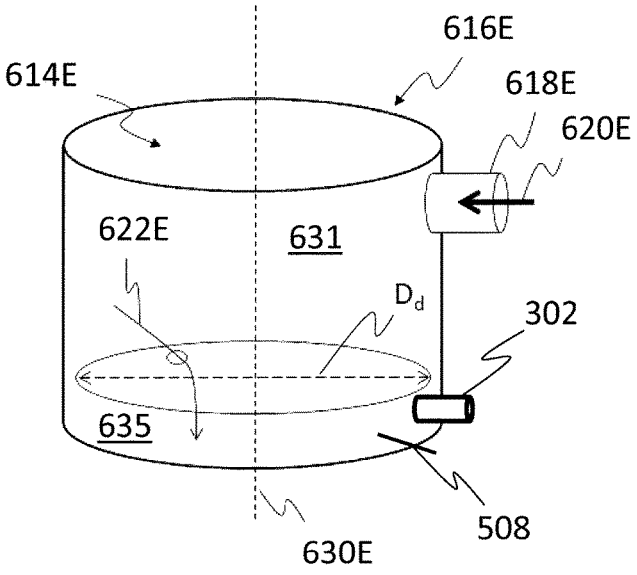
FIG. 6M shows a perspective drawing similar to FIG. 6L with instrument package located on a side in accordance with embodiments of the present disclosure.

FIG. 6M is similar to the embodiment shown in FIG. 6L, except the sensors 302, 508 are mounted on the side, instead of through the substrate plate.

A third feature is that, even when the fuel-air mass flow rate is increased into the volume combustion regime, the semi-cone geometry alters the cavity flame structure so that the power density is increased, and a smaller flame is require to achieve a prescribed level of heat generation. Because the fuel-air mass flow is equally distributed over the surface of the porous combustion substrate, when driven into a volume combustion regime the entire length of the flame is equally impinged by the premix fuel. Hence, the structure of the body of the flame—normally divided into cool and hot regions—is altered to produce a hotter, more efficient combustion process. As a result, the same heat generation capacity is achieved by a smaller flame size with higher power density, and more complete combustion can occur in a smaller burner cavity.

Figure 7:
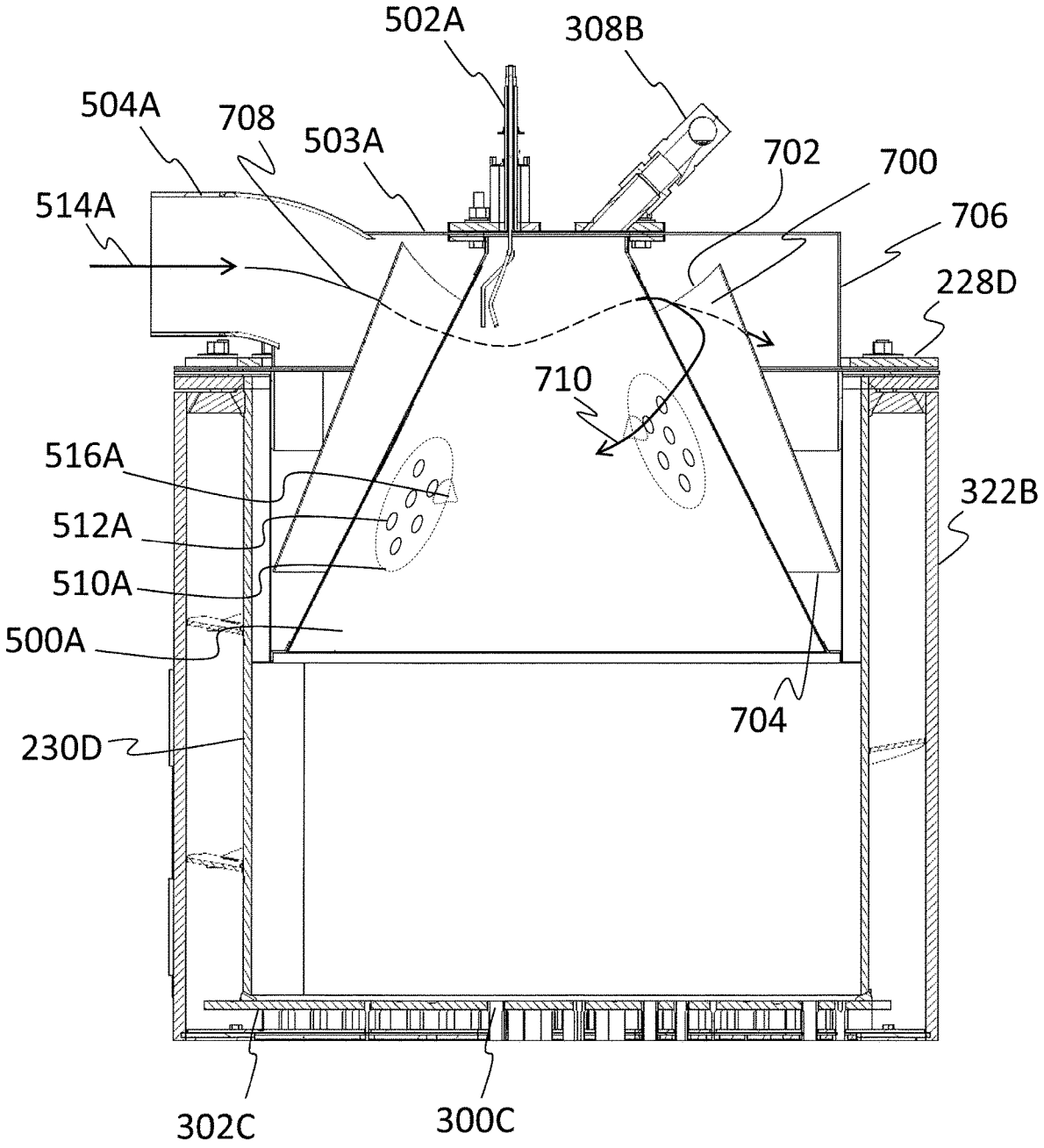
FIG. 7 shows a cross-section diagram of an embodiment of a premix combustion system with a single semi-conical combustion substrate and a flow baffle in accordance with embodiments of the present disclosure.

Moreover, these beneficial aspects may be enhanced by guided control of the fuel-air flow field as it impinged on the outer surface of the combustion substrate. Disclosed are embodiments that further comprise a baffle or guide designed to distribute the incoming fuel-air mixture so that the local mass flow and velocity is close to (or substantially) uniform over the burner combustion substrate. FIG. 7 shows a cross-sectional diagram of an embodiment of as inward-firing premix burner comprising a semi-cone combustion substrate 500A. The burner combustion substrate is porous to the flow of premix fuel-air mixtures in a vapor state. Substrate pores 512A are distributed over the area of the burner combustion substrate to support a flame front 516A on the interior surface. (The pore 512A size, in a local area 510A, is exaggerated in the diagram for clarity and are not meant to be to scale.) The combustion process may be monitored by a sensor 308B which can detect if the flame is extinguished.

This embodiment further comprises a flow guide or baffle 700, between the walls of the burner casing 706. In this embodiment the baffle is an unperforated, non-porous substrate in the shape of a semi-cone with a non-planar proximal edge 702 and a planar, circular distal edge 704, disposed between the burner head 503A and the inner furnace 230D wall. Most of the premix fuel-air mixture 514A entering the burner inlet 504A impinges upon the baffle 708 so that the high-velocity flow doesn't disproportionately impinge upon the combustion substrate immediately adjacent to the inlet opening. Instead, the premix fuel-air flow is primarily directed around the outside of the baffle between the baffle 700 and the burner casing 706. The baffle proximal edge is shaped to that the fuel-air flow spills over the baffle proximal edge 702, passes 710 through burner combustion substrate pores 512A, and is ignited to form a combustion flame 516A since, by design, the premix fuel-air mixture is in the correct ratio to support ignition at the operating temperature and pressure. At the beginning of burner operation, combustion can also be initiated by a spark from an igniter 502A.

In a boiler application comprising a shell and tube heat exchanger, the combustion products (e.g., hot gases, particulate byproducts) flow towards the tubesheet 302C where they pass through the openings 300C of the heat exchanger tubes. Heat generated by the combustion process is transferred across the walls of the heat exchanger tubes to production fluid occupying the space between the outer surfaces of the furnace 230D and heat exchanger tubes and the inner surface of the pressure vessel 322B, sealed at one end by the boiler top head 228D.

Figure 8:
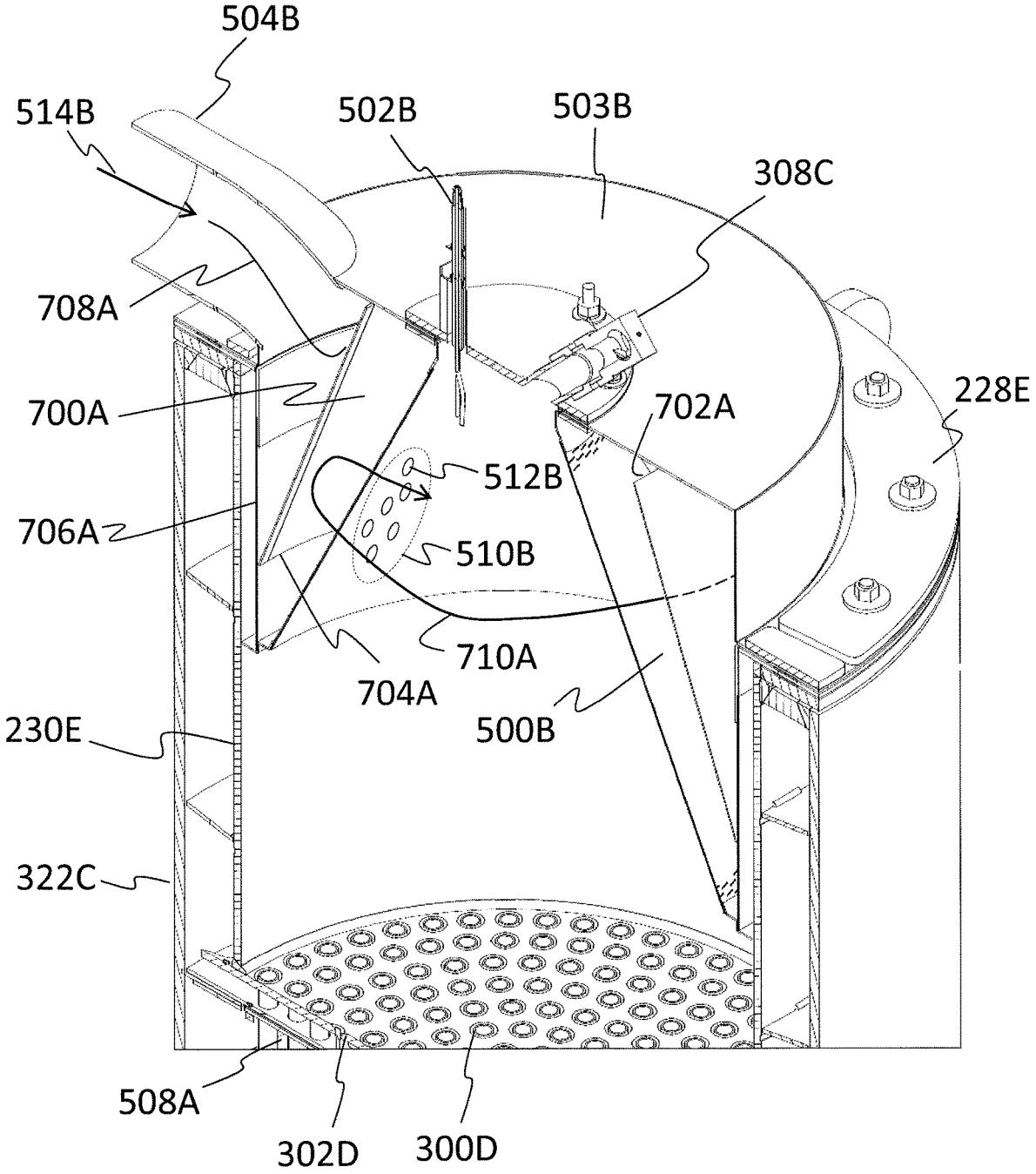
FIG. 8 shows a cutaway diagram of an embodiment of a premix combustion system with a single semi-conical combustion substrate and a flow baffle in accordance with embodiments of the present disclosure.

FIG. 8 shows a cutaway diagram of the inward-firing premix burner comprising a semi-cone combustion substrate and further comprising a semi-conical baffle disclosed in FIG. 7. The burner combustion substrate 700A is porous to the flow of premix fuel-air mixture in a vapor state. Substrate pores 512B are distributed over the area of the burner combustion substrate 500B to support a flame front on the interior surface. (Shown are pores in a small area 510B of the combustion substrate, not to scale.) The combustion process may be monitored by a sensor 308C which can detect if the flame is extinguished, and combustion can also be initiated by a spark from an igniter 502B.

A flow baffle 700A guides the fuel-air mixture flow between baffle and the walls of the burner casing 706A. As before, in this embodiment the baffle is an unperforated, non-porous substrate in the shape of a semi-cone with a non-planar proximal edge 702A and a planar, circular distal edge 704A, disposed between the burner head 503B and the inner furnace 230E wall. Most of the premix fuel-air mixture 514B entering the burner inlet 504B impinges 708A upon the baffle so that the high-velocity flow doesn't disproportionately impinge upon the combustion substrate immediately adjacent to the inlet opening. Instead, the premix fuel-air flow is primarily directed around the outside of the baffle between the baffle 700A and the burner casing 706A. The baffle proximal edge is shaped to that the fuel-air flow spills over the baffle proximal edge 702A, and passes 710A through burner combustion substrate pores 512B.

In a boiler application comprising a shell and tube heat exchanger, the combustion products (e.g., hot gases, particulate byproducts) flow towards the tubesheet 302D where they pass through the openings 300D of the heat exchanger tubes 508A. Heat generated by the combustion process is transferred across the walls of the heat exchanger tubes to production fluid occupying the space between the outer surfaces of the furnace 230E and heat exchanger tubes 508A and the inner surface of the pressure vessel 322C, sealed at one end by the boiler top head 228E.

Figure 9:
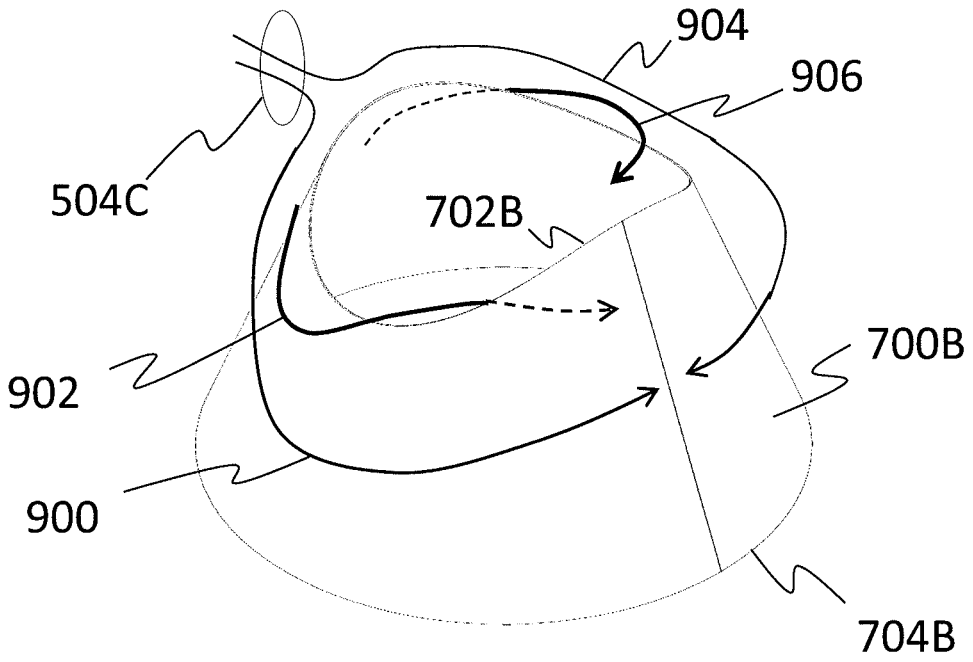
FIG. 9 shows a cutaway diagram of an embodiment of a premix fuel flow baffle for a combustion system with a single semi-conical combustion substrate in accordance with embodiments of the present disclosure.

FIG. 9 shows details of an embodiment of the baffle used to distribute the premix fuel-air flow field impinging on the outer burner combustion substrate shown in FIG. 8. As described above, in this embodiment the baffle is in the shape of a semi-cone with a non-planar proximal edge 702B and a planar, circular distal edge 704B. The fuel-air mixture entering the burner inlet 504C at the maximum velocity is deflected by the baffle, directed to stream both behind 904 and in front 900 of the baffle 704B. Low regions in the proximal edge 702B allow the fuel-air mixture to flow inside the baffle both behind 906 and in the front 902 of the baffle. The distal edge 704B of the baffle is disposed on the furnace wall, and the flow around the distal edge is insignificant to the flow dynamics in this embodiment.

Figure 10:
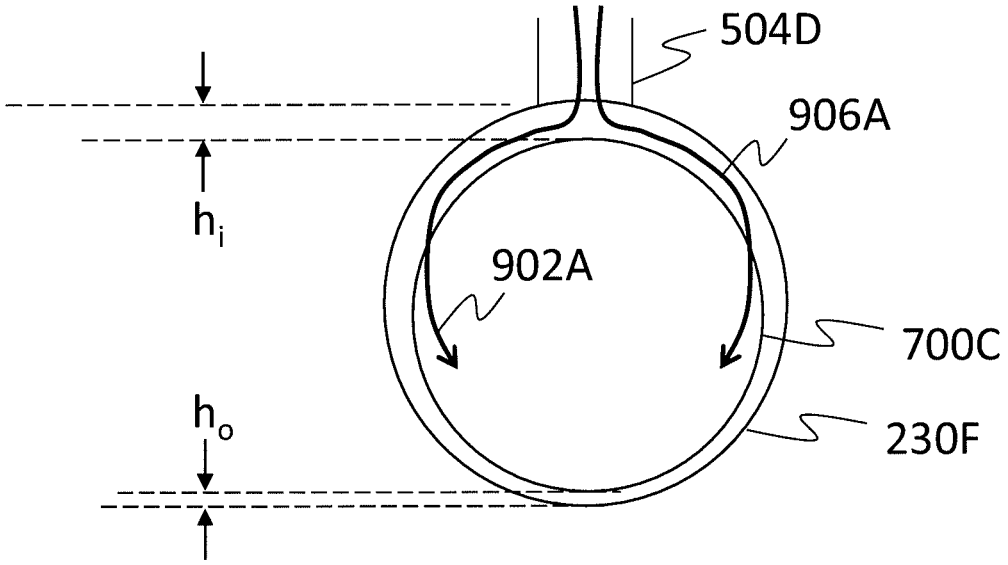
FIG. 10 shows a top view of an embodiment of a premix fuel flow baffle for a combustion system with a single semi-conical combustion substrate in accordance with embodiments of the present disclosure.

FIG. 10 shows the fuel-air mixture flow from a cross-sectional view looking down on the burner. The flow enters the burner inlet 504D and, separated by the baffle, flows both right 906A and left 902A in the space between the baffle 700C and the furnace wall 230F. Note that in this embodiment the axis of the baffle semi-cone is offset from the axis of the burner combustion substrate semi-cone so that the distance between the baffle and the furnace wall opposite the burner inlet, $h_o$, is smaller than the distance between the baffle and the furnace wall adjacent to the burner inlet, $h_i$, with $h_o<h_i$.

Figure 11:
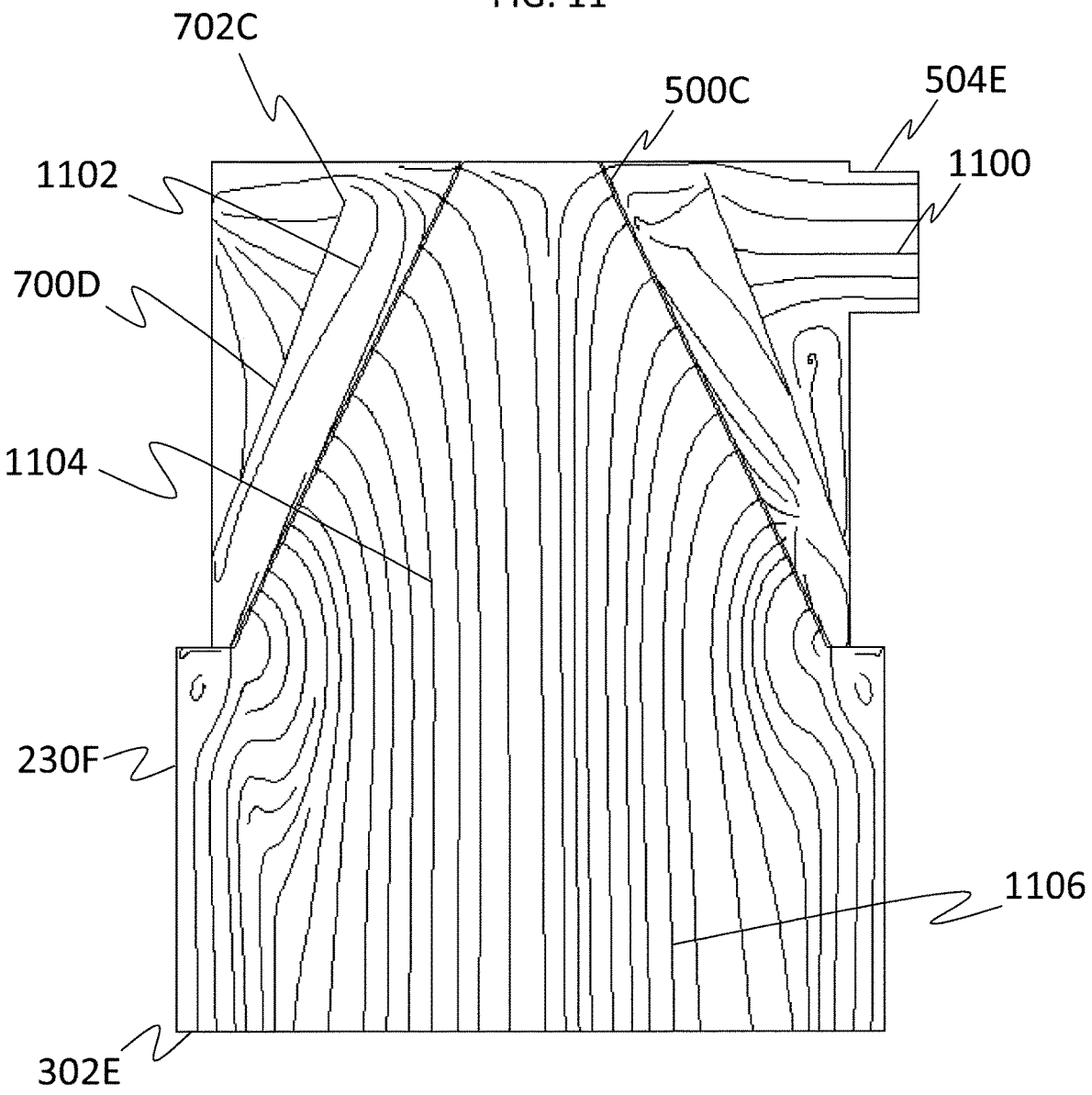
FIG. 11 shows a cross-section of calculated streamlines for a simulated flow of an embodiment of a premix combustion system with a single semi-conical combustion substrate and a flow baffle in accordance with embodiments of the present disclosure.

FIG. 11 shows a cross-sectional diagram of the streamlines of a computation fluid dynamic (CFD) computer model simulation of an embodiment of an inward-firing premix burner comprising a semi-cone combustion system as an element of a fluid heating system (hydronic boiler) as described in FIG. 7. (Simulated burner output: 3 MMBUT/hr (879 kW); natural gas fuel; 16% excess air; water temperature of 180° F.) Each streamline shows the computed path of a unit of mass flow through the apparatus. A fuel-air mixture 1100 enters the burner inlet 504E and is guided around the burner circumference by the baffle 700D. The shape of the baffle's proximal edge 702C permits the flow 1102 of the fuel-air mixture into the region between the baffle 700D and the porous burner combustion substrate 500C where it is ignited. The resulting hot gases and combustion product flow in the interior of the semi-cone burner combustion substrate 1104 and furnace walls 203F in streamlines that become nearly parallel 1106 and impinge upon the heat exchanger tubesheet 302E.

Figure 12:
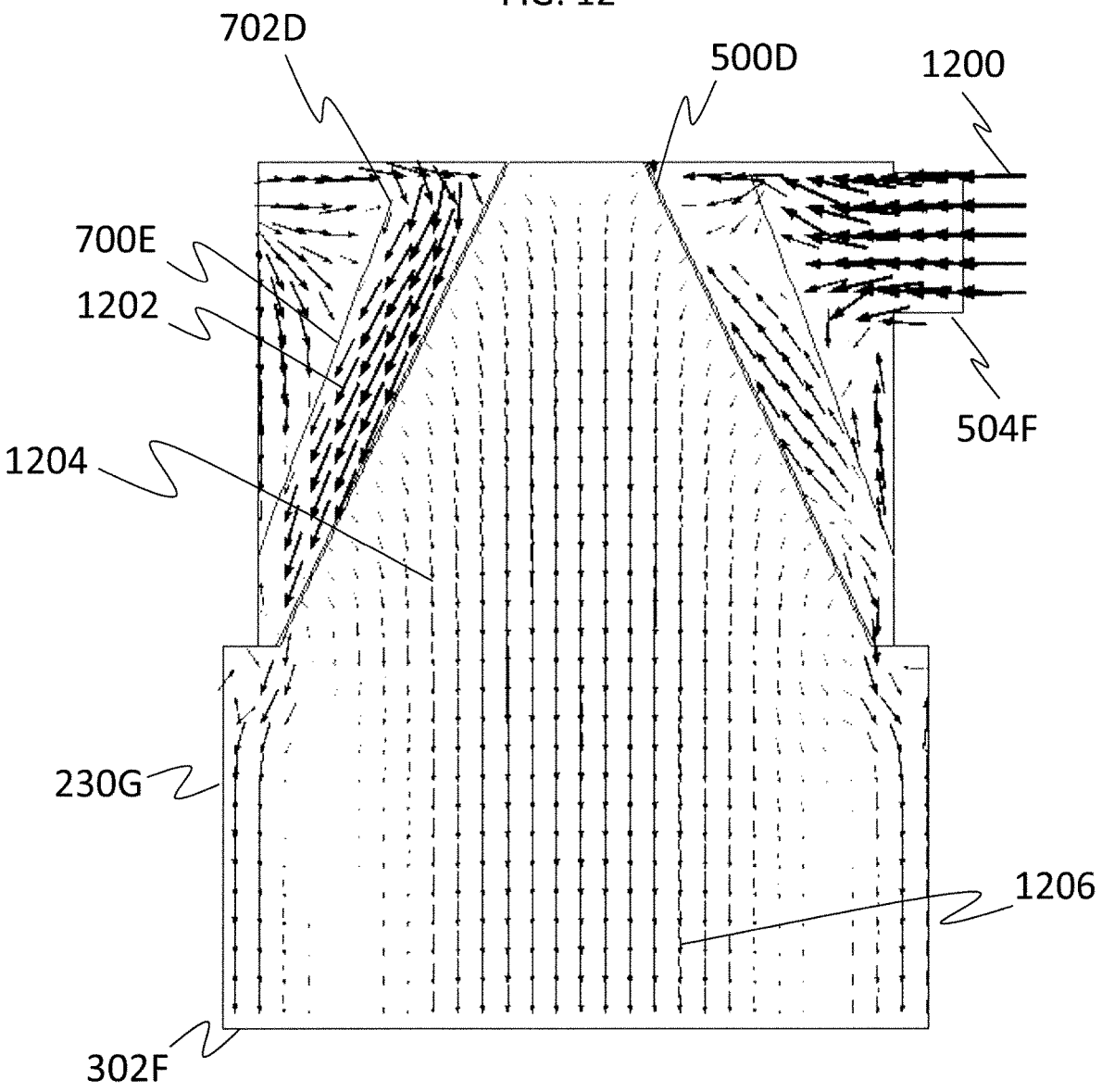
FIG. 12 shows a cross-sectional diagram of calculated velocity vectors for a simulated flow of an embodiment of a premix combustion system with a single semi-conical combustion substrate and a flow baffle in accordance with embodiments of the present disclosure.

FIG. 12 shows a cross-sectional diagram of local velocity vectors of a computation fluid dynamic (CFD) computer model simulation of an embodiment of an inward-firing premix burner comprising a semi-cone combustion system as an element of a fluid heating system (boiler) as described in FIG. 7 and FIG. 11. Each velocity vector shows the computed local velocity of a unit of mass flow at a specific location in the apparatus. In this simulation, the fuel-air mixture 1200 enters the burner inlet 504F at a velocity of 40 m/s and is guided around the burner circumference by the baffle 700E. The shape of the baffle's proximal edge 702D permits the flow 1202 of the fuel-air mixture into the region between the baffle 700E and the porous burner combustion substrate 500D at a more uniform velocity of 16 m/s where it is ignited. The resulting hot gases and combustion product flow at a nearly (or substantially) uniform velocity of 5 m/s in the interior of the semi-cone burner combustion substrate 1204 and furnace walls 203G in velocity vectors that become nearly parallel 1206 and impinges upon the heat exchanger tubesheet 302F.

Figure 13:
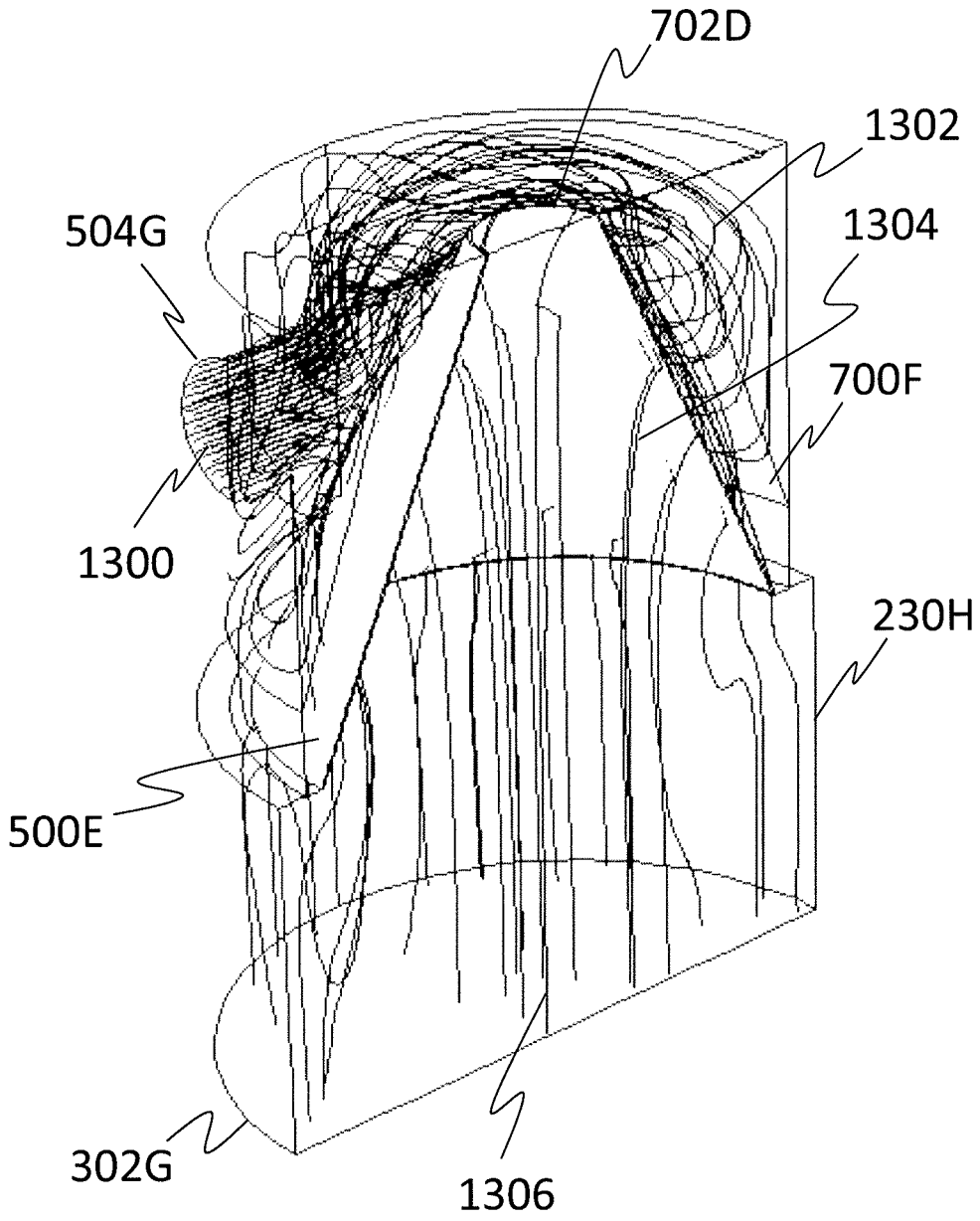
FIG. 13 shows a cross-sectional diagram of calculated streamlines for a simulated flow of an embodiment of a premix combustion system with a single semi-conical combustion substrate and a flow baffle in accordance with embodiments of the present disclosure.

FIG. 13 shows a perspective diagram of the streamlines of a computation fluid dynamic (CFD) computer model simulation of an embodiment of an inward-firing premix burner comprising a semi-cone combustion system as an element of a fluid heating system (boiler) as described in FIG. 7 and FIG. 11. Each streamline shows the computed path of a unit of mass flow through the apparatus. A fuel-air mixture 1300 enters the burner inlet 504G and is guided around the burner circumference by the baffle 700F. The shape of the baffle's proximal edge 702D permits the flow 1302 of the fuel-air mixture into the region between the baffle 700F and the porous burner combustion substrate 500E where it is ignited. The resulting hot gases and combustion product flow in the interior of the semi-cone burner combustion substrate 1304 and furnace walls 203H in streamlines that become nearly parallel 1306 and impinge upon the heat exchanger tubesheet 302G.

Thus, a fourth aspect is that the semi-cone combustion substrate geometry promotes substantial homogeneity and substantial uniformity of the flow field exiting the burner casing. This is particularly important in apparatus comprising heat-generating burners for fluid heating applications utilizing, for example, shell-and-tube heat exchangers. Referring to FIG. 5, in these applications, non-uniform flow patterns and temperature gradients implies that heat exchanger tubes 508 may receive combustion products at different conditions across the tubesheet 302B. For example, in the outward firing cylindrical burner of FIG. 4 and FIG. 5, flow of combustion gases into the heat exchanger openings 300A tends to be cool near the periphery of the tubesheet 302A where the flow has been exposed to the walls of the burner casing 230B and hot near the center where vortices 407 may develop. Embodiments comprising semi-cone combustion substrates can produce substantially uniform flow into the tubesheet and reduce or eliminate the temperature gradients present in alternative embodiments.

Towards this end, in certain embodiments a composite semi-cone combustion substrate is used when optimization of the combustion flow field over the height, H, requires a change in the local generator angle (alternatively, range of generator angles in the case of a general semi-cone). Otherwise, when optimization of the combustion flow field can be achieved using a single semi-cone, a semi-cone, truncated cone or frustum shape may be used.

A fifth feature is that substantially uniform combustion over the surface of the substrate and uniformity of the flow field exiting the burner contributes to an increase in thermodynamic efficiency of the combustion system. A result of the substantially uniform flow field and temperature distribution of combustion products generated by the premix burner comprising a composite semi-cone combustion substrate is an increase in overall system thermodynamic efficiency. This is a particularly important result for applications like fluid heating where energy efficiency and reduction of environmentally hazardous byproducts are key.

The inventors have also unexpectedly discovered that a plurality of concentric porous combustion porous surfaces or substrates, which may be collectively referred to herein as the "substrate", can have a beneficial effect on the substantial uniformity of the fuel-air mixture velocity as it enters the interior of the burner combustion volume. Any number of layers or porous structures may be used if desired to make up the substrate provided they provide the porosity to provide the performance and function described herein.

Figure 14:
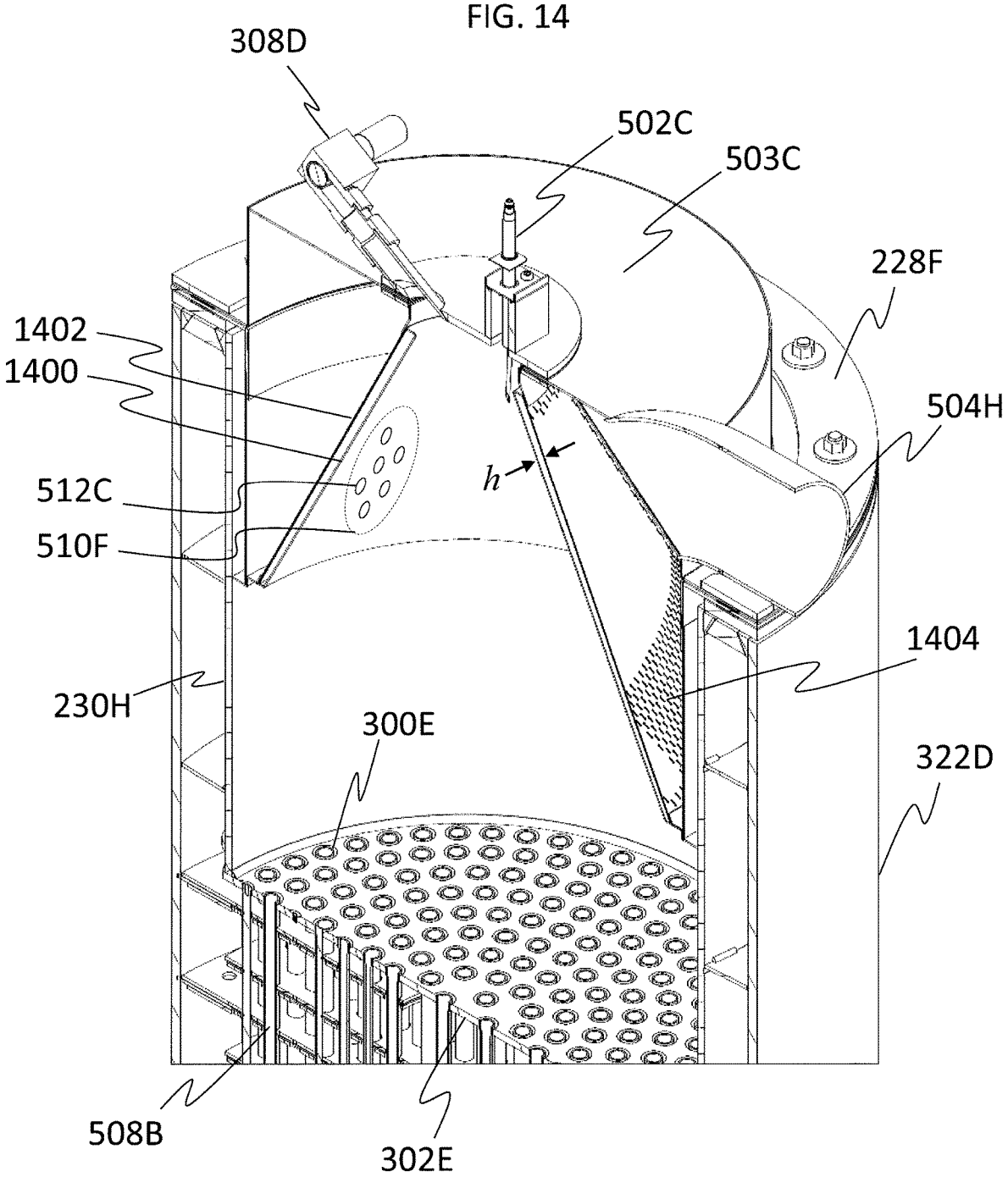
FIG. 14 shows a cross-sectional diagram of an embodiment of a premix combustion system with a plurality of semi-conical combustion substrates and a flow baffle in accordance with embodiments of the present disclosure.

FIG. 14 shows a perspective diagram of an embodiment of an inward-firing premix burner comprising two concentric semi-cone combustion substrates. A first semi-cone shaped combustion substrate 1400 is disposed between the burner top head 503C and the inner substrate of the furnace 230H. In this embodiment, a second semi-cone shaped combustion substrate 1402 is disposed between the burner top head 503C and the inner substrate of the furnace 230H and concentric to the first semi-cone shaped combustion substrate 1400, separated by a distance h.

Both the first 1400 and second 1402 burner combustion substrates are porous to the flow of premix fuel-air mixtures predominately in a vapor state. Pores 1404 are distributed over the area of the burner combustion substrate to support a flame front on the interior surface of the first burner combustion substrate. (The pore 512C size in a local area 510F are exaggerated in the diagram for clarity and are not meant to be to scale.) The combustion process may be monitored by a sensor 308D which can detect if the flame is extinguished. At startup, combustion may be initiated using an igniter 502C disposed in the interior of the first burner combustion substrate.

In the embodiment shown a premix fuel-air mixture enters the inlet 504H of the burner and flows around and through the burner combustion substrate inward to the interior of the burner combustion substrate.

In a boiler application comprising a shell and tube heat exchanger, the combustion products (e.g., hot gases, particulate byproducts) flow towards the tubesheet 302E where they pass through the openings 300EB of the heat exchanger tubes 508B. Heat generated by the combustion process is transferred across the walls of the heat exchanger tubes 508B to production fluid occupying the space between the outer surfaces of the furnace 230H and heat exchanger tubes 508B and the inner surface of the pressure vessel 322D, sealed at one end by the boiler top head 228F.

The various components of the premix fuel burner combustion system can each independently comprise any suitable material. Use of a metal is specifically mentioned. Representative metals include iron, aluminum, magnesium, titanium, nickel, cobalt, zinc, silver, copper, and an alloy comprising at least one of the foregoing. Representative metals include carbon steel, mild steel, cast iron, wrought iron, a stainless steel such as a 300 series stainless steel or a 400 series stainless steel, e.g., 304, 316, or 439 stainless steel, Monel, Inconel, bronze, and brass. Specifically mentioned is an embodiment in which the premix fuel burner combustion system components each comprise steel, specifically stainless steel. The premix burner combustion system may comprise a burner head, a combustion substrate, a baffle, a furnace wall that can each independently comprise any suitable material. Use of a steel, such as mild steel or stainless steel this mentioned. While not wanting to be bound by theory, it is understood that use of stainless steel in the dynamic components can help to keep the components below their respective fatigue limits, potentially eliminating fatigue failure as a failure mechanism, and promote efficient heat exchange.

Figure 15:
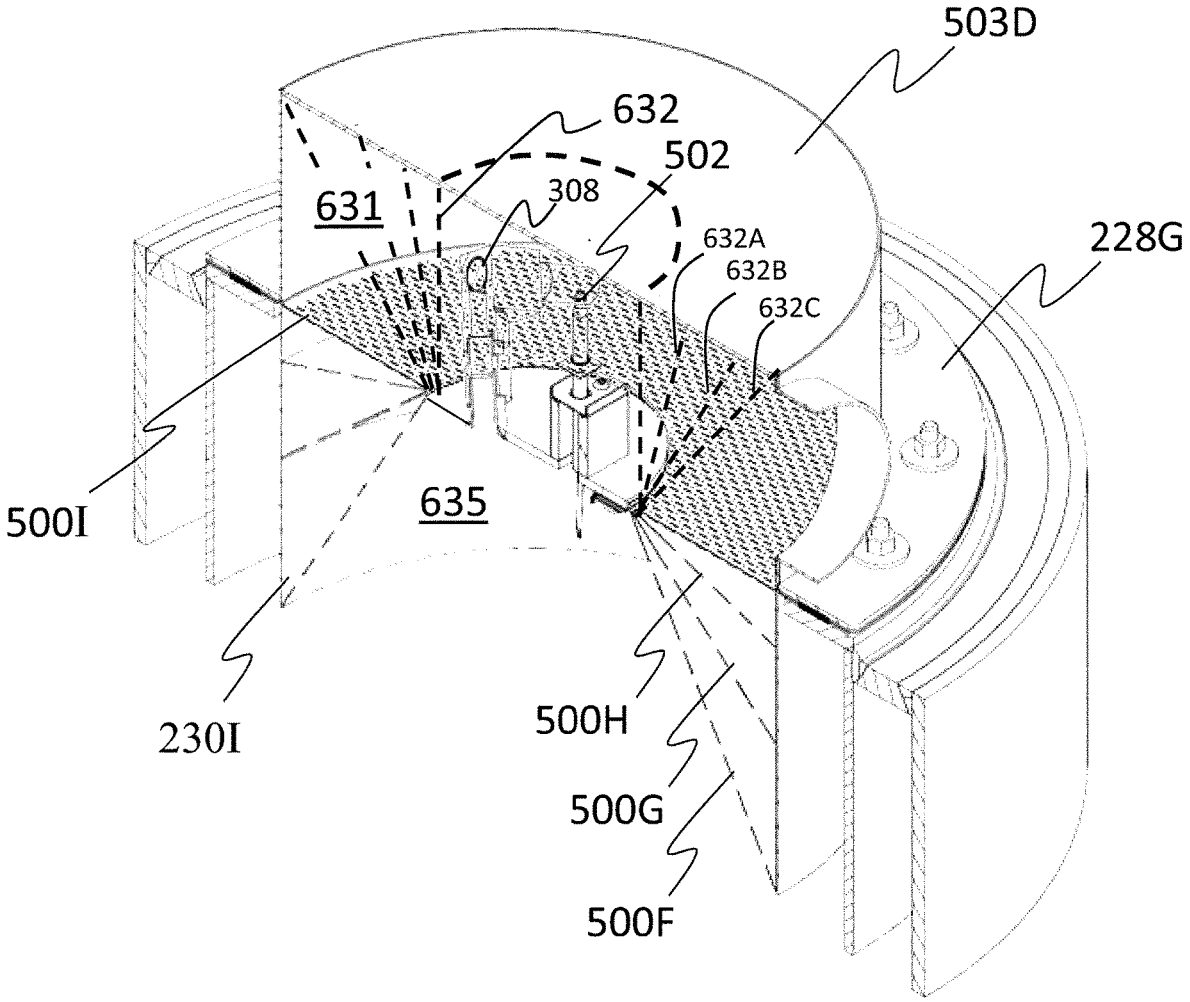
FIG. 15 shows a prospective view of an embodiment of a premix combustion system with combustion substrates of various substrate angles, including 90 degrees, juxtaposed to illustrate a sequence of design options with varying surface areas in accordance with embodiments of the present disclosure.

A sixth feature is that of a flat substrate (annular substrate with $D_d$ and $D_p$ prescribed) is the geometrical limit of a sequence of semi-cone combustion substrate configurations within the inventive species sharing a common furnace diameter. FIG. 15 shows the furnace wall 2301 bounding a family enclosed by the burner head 228G bounding a sequence of semi-cone burner combustion substrates of decreasing angle including a substrate with a small (generator) angle 500F, intermediate angle 500G, large angle 500H and an angle of ninety degrees (90°) 500I (flat plate or annulus). (Note that only one burner combustion substrate structure is present in any specific operating configuration embodiment, notwithstanding the multi-layer substrate configuration described above and an embodiment of which is illustrated in FIG. 14. FIG. 15 is meant only to illustrate the relationship of a collection of possible substrates of different angles within the species of semi-cone substrate burners juxtaposed in a prescribed furnace geometry.)

FIG. 15 also shows the burner pre-combustion cavity 631 and instrument plate located in the center of the substrate disk. A cylinder 532 may connect the upper surface 503D to the instrument plate to shield the instruments from the fuel-air mixture and/or provide external access to the instruments 502, 308. The walls of the cylinder 632 may be angled shown as dash lines 632A, 632B, 632C in a shape of a cone or other shape, which may help direct the fuel-air mixture toward the flat substrate. A similar cylinder is shown in FIG. 16.

A family of semi-cone substrates sharing a common finance diameter (e.g., $D_d$ in FIG. 5 and FIG. 6B) possesses the important property that the surface area of the substrate supporting the pores increases with decreasing substrate angle, a (equivalently, with increasing semi-cone height). This enables those skilled in the art of burner design to select the combustion substrate geometry to achieve a heat production capacity (equivalently, burner surface load, the amount of heat produced by combustion per unit surface area of substrate surface in Watts per centimeter squared). That is, for a prescribed furnace configuration with distal diameter ($D_d$) and proximal diameter ($D_p$), the surface area of the substrate is minimum for a substrate angle, $\alpha=90°$, and increases with decreasing substrate angle. If the design target burner load can be achieved using a desired perforation pattern and density on a flat (or annular) substrate ($\alpha=90°$) at a prescribe temperature, this option provides configuration that is easily and cheaply manufactured and still retains desirable premix flow, heat distribution, temperature and flame combustion characteristics. If the burner load cannot be achieved using this minimal surface area, a semi-cone substrate with angle $0<\alpha<90°$ is used, which increases the available surface area and, thereby, total burner system heat production capacity.

Figure 16:
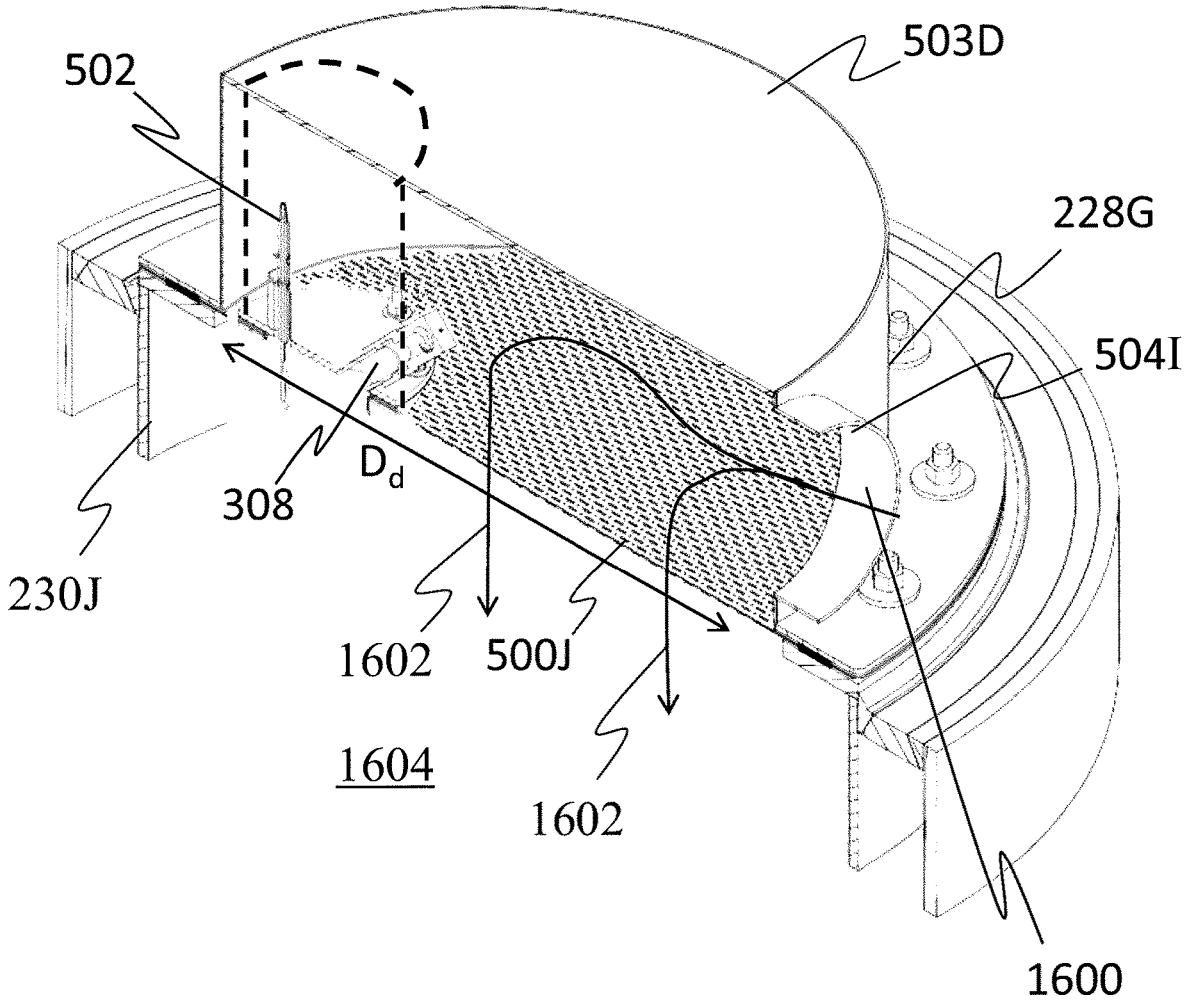
FIG. 16 shows a perspective view of an embodiment of a premix combustion system with a combustion substrate at a substrate angle of 90 degrees (flat anulus) in accordance with embodiments of the present disclosure.

FIG. 16 shows an embodiment of the burner combustion system incorporating a substrate with a substrate angle equal to 90 degrees disposed in a circular furnace wall of diameter $D_d$. Not shown is the mounting for mounting plate for the optical sensor and igniter which is disposed in the opening near the center of the substrate with diameter $D_p$. In this embodiment, the furnace geometry is prescribed by the circular furnace wall 203J that (including the flange mount) defined a distal diameter, $D_d$, for the substrate. The substrate 500J is sandwiched in the burner to head 228G mounting flange to hold the substrate in place for operation. A gas-air premixture 1600 flows into the inlet conduit 5041 and is dispersed in the volume defined by the substrate 500J and the burner head 503D. The gas-air premixture penetrates 1602 the substrate pores into the combustion volume 1604.

The principles and characteristics of an embodiment similar to that shown in FIG. 16 was tested using a 1/18th scaled-down instrumented prototype. The scaled-up results are displayed in Table 2. The instruments, e.g., temperature, pressure, flames, gas analyzers, etc. were located on a side of the substrate or burner (not on the substrate flat surface as shown in FIG. 16), also, the fuel-air mixture was provided substantially vertically from an inlet at the top of the burner (not from the side as shown in FIG. 16).

TABLE 2

| Parameter | Description and Values |
|---|---|
| Plate Material | 439 Stainless Steel |
| Plate Thickness | 20 GA, 0.9525 mm |
| Port Type & Dimensions | Slots 1 mm × 4 mm dimensions. Port Area = 3.79 $mm^2$ |
| Number of Slots | 3,149 |
| Flow Mean Velocity | 1.2 m/s to 23 m/s tested |
| Flow Port Loading | 3.69 $W/mm^2$ to 73.71 $W/mm^2$ |
| Burner Input | 879765.4 W |
| Cone Area (flat plate) | 94,469.1 $mm^2$ |
| $D_p$ | 0 mm |
| $D_d$ | 347 mm |
| Height | 0 mm |

The embodiment test results demonstrate the burner with a combustion substrate angle of ninety degrees (flat substrate) and a regular pattern of slots exhibits stable suspended flame combustion over a wide range of premix fuel-air mixture flow rates, substrate surface loading and heat production conditions.

Figure 17:
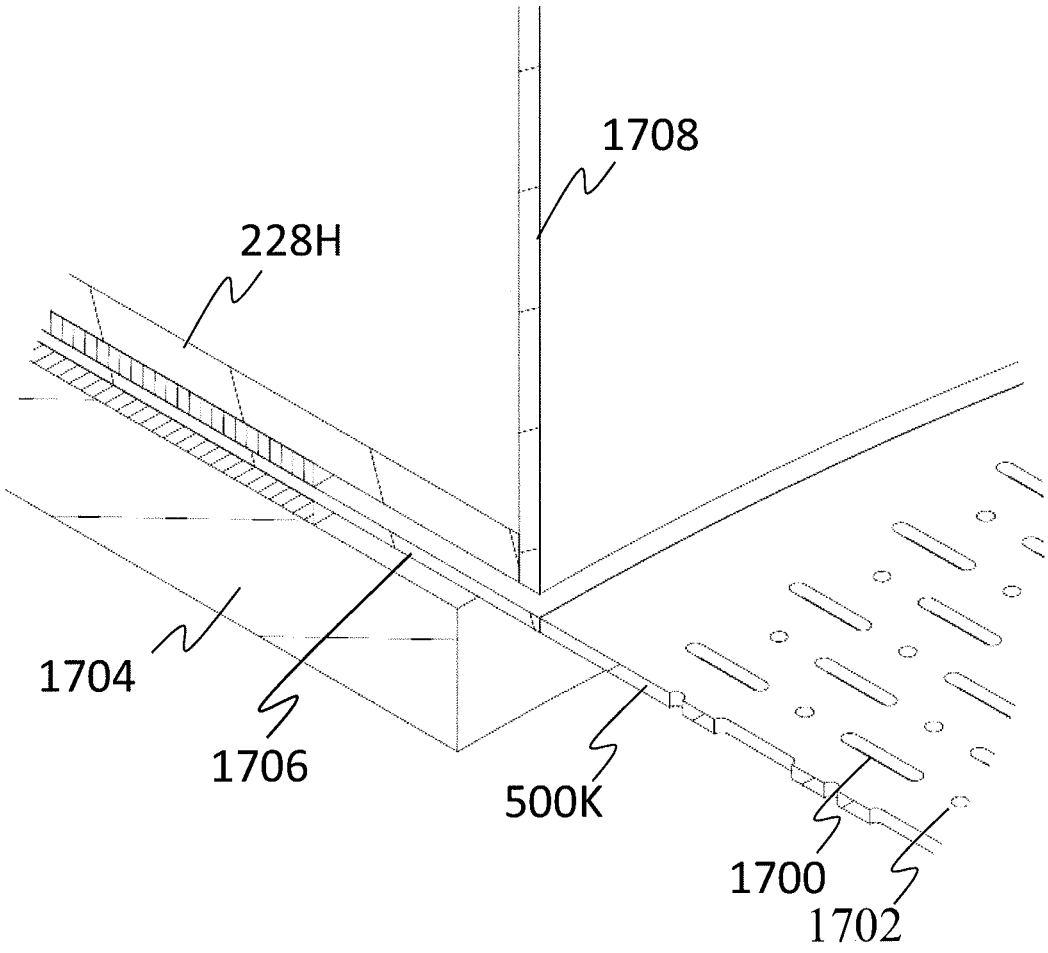
FIG. 17 shows a perspective view of an embodiment of a premix combustion system with a combustion substrate at a substrate angle of 90 degrees displaying the detail of fixing the substrate to the burner head and the regular pattern of pore holes and slots in accordance with embodiments of the present disclosure.

There are equivalent methods for disposing the burner combustion substrate on the furnace structure. FIG. 17 shows one simple embodiment of an attachment method that secures the combustion substrate 500K, here shown as a flat (annular substrate with angle equal to 90 degrees) to the burner top head 228H; however, this disclosure is not limited to this specific embodiment but encompasses all equivalent methods of securing the substrate in position for conducting premix flow and supporting the flame structure near the surface of the substrate. In the embodiment shown the burner combustion substrate 500K extends 1706 into the space between the burner top head flange 228H and the upper wall of the furnace top head 1704. The volume that contains the premix flow before it penetrates the pores is defined in part by the wall of the burner head 1708 which is secured to the furnace top head; for instance, using a threaded bolt shaft and nut fastener (not shown), although this embodiment is only one of several equivalent methods for securing the burner top head to the furnace top head. The burner substrate 500K is perforated to allow flow penetration by the premix fuel-air mixture. The perforations shown in the embodiment comprise a regular pattern of slots 1700 and circular holes, although other perforation patterns may be selected by those skilled in the art of burner design.

Figure 18:
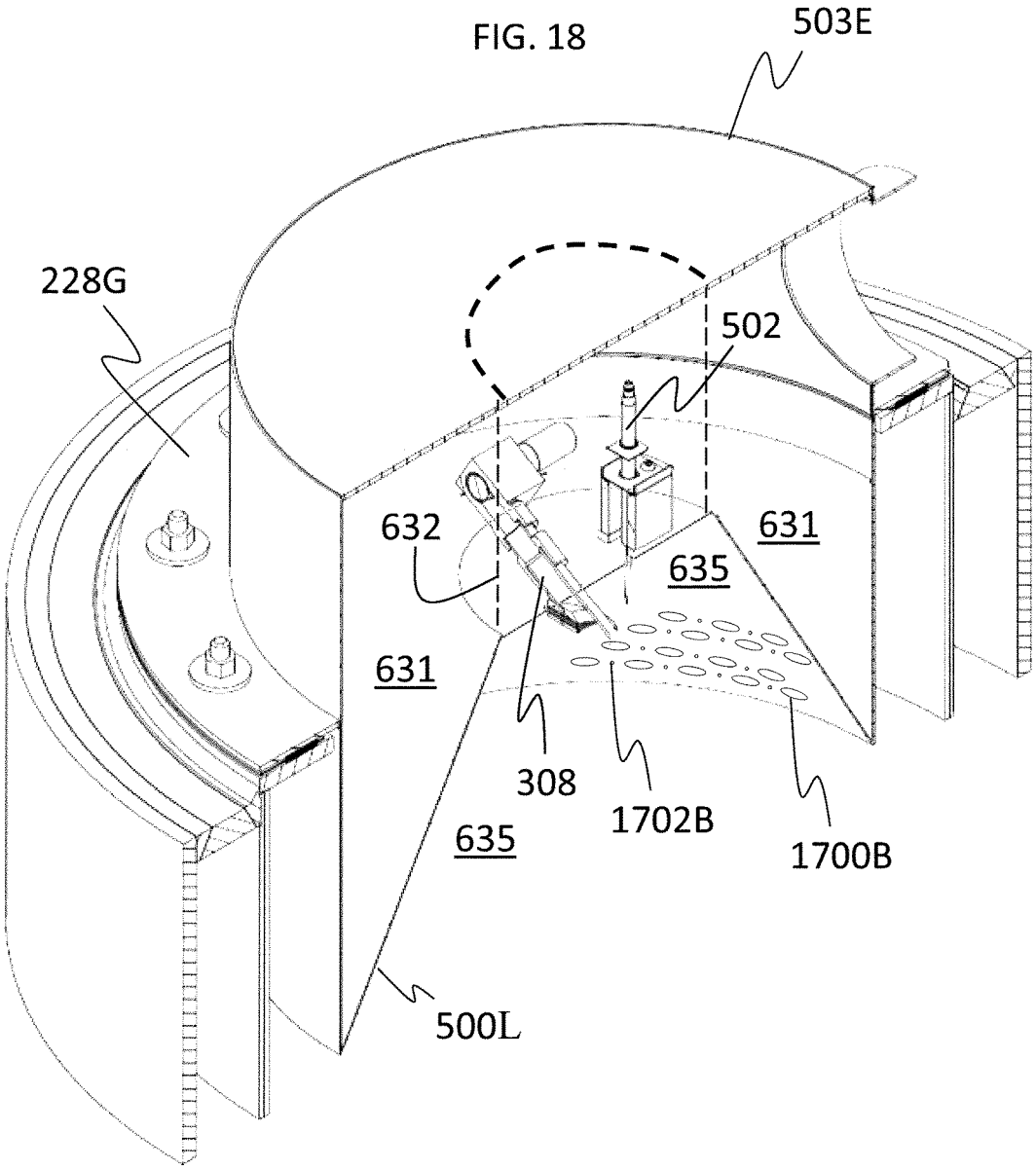
FIG. 18 shows a perspective view of an embodiment of a premix combustion system with a combustion substrate at a substrate angle of 90 degrees displaying the detail of the pore structure comprising a hole and slot configuration in accordance with embodiments of the present disclosure.

The design of the perforation pattern, dimensions and distributions are separate inventive concepts from the semi-cone substrate structure, and the resulting flow and temperature properties can be exploited in various distinct configurations. For example, FIG. 18 shows an embodiment of a semi-cone burner substrate 500L with top head 503E disposed on the furnace head 228G comprising a pattern of slots 1700B and circular holes 1702B for a substrate with an acute generator angle. The desirable flow, temperature and combustion properties such a pore pattern can be expected to have similarities in two different semi-cone geometries, but will also have distinct properties that may be exploited by one skilled in the art of burner design.

Embodiments Further Disclosed

Embodiment A

Further disclosed is a premix burner comprising: a burner casing with an inlet conduit for a premix fuel-air mixture to be disposed in the burner casing; a porous burner combustion substrate disposed in the burner casing wherein a premix fuel-air mixture enters the inlet conduit on an outside (exterior) of the burner combustion substrate. A premix fuel-air mixture is disposed under pressure through the burner inlet to an outside of the porous burner combustion substrate; passes through pores in the burner combustion substrate to an interior of the substrate; the fuel-air mixture is ignited in the interior of the burner combustion substrate; combustion gases and products flow from the interior of the burner combustion substrate through an outlet in the burner casing.

Embodiment B

Further disclosed is the premix burner of Embodiment A, wherein the porous burner combustion substrate has the shape of a cylinder.

Embodiment C

Further disclosed is the premix burner of Embodiment A, wherein the porous burner combustion substrate has the shape of a composite semi-cone.

Embodiment D

Further disclosed is the premix burner of Embodiment A, wherein the porous burner combustion substrate has the shape of a semi-cone.

Embodiment E

Further disclosed is the premix burner of Embodiment A, wherein the porous burner combustion substrate has the shape of a truncated cone.

Embodiment F

Further disclosed is the premix burner of Embodiment A, wherein the porous burner combustion substrate has the shape of a circular truncated cone.

Embodiment G

Further disclosed is the premix burner of Embodiment A, wherein the porous burner combustion substrate has the shape of a right circular truncated cone.

Embodiment H

Further disclosed is the premix burner of Embodiment A, wherein the porous burner combustion substrate has the shape of a frustum.

Embodiment I

Further disclosed is the premix burner of Embodiment A, wherein the porous burner combustion substrate has the shape of a circular frustum.

Embodiment J

Further disclosed is the premix burner of Embodiment A, wherein the porous burner combustion substrate has the shape of a right circular frustum.

Embodiment K

Further disclosed is the premix burner of any of Embodiments A to J, further comprising a plurality of burner casing inlets disposed on the burner casing.

Embodiment L

Further disclosed is a premix burner of any of the Embodiments A to K, wherein the semi-cone generator angle is ninety degrees.

Further disclosed is a hydronic fluid heating system (equivalently, a "hydronic boiler") comprising a premix combustion system of any of Embodiments A to L or elsewhere disclosed in this specification.

Further disclosed is a steam fluid heating system (equivalently, a "steam boiler") comprising a premix combustion system of any of Embodiments A to K or elsewhere disclosed in this specification.

Further disclosed is a thermal fluid heating system (equivalently, a "thermal fluid boiler") comprising a premix combustion system of any of Embodiments A to K or elsewhere disclosed in this specification.

Further disclosed is a packaged burner comprising a premix combustion system of any of Embodiments A to K or elsewhere disclosed in this specification.

The disclosed system can alternately comprise, consist of, or consist essentially of, any appropriate components herein disclosed. The disclosed system can additionally be substantially free of any components or materials used in the prior art that are not necessary to the achievement of the function and/or objectives of the present disclosure.

The terms "a" and "an" do not denote a limitation of quantity, but rather denote the presence of at least one of the referenced item. The term "or" means "and/or" unless clearly indicated otherwise by context. Reference throughout the specification to "an embodiment", "another embodiment", "some embodiments", and so forth, means that a particular element (e.g., feature, structure, step, or characteristic) described in connection with the embodiment is included in at least one embodiment described herein, and may or may not be present in other embodiments. In addition, it is to be understood that the described elements may be combined in any suitable manner in the various embodiments. "Optional" or "optionally" means that the subsequently described event or circumstance may or may not occur, and that the description includes instances where the event occurs and instances where it does not. The terms "first," "second," and the like, "primary," "secondary," and the like, as used herein do not denote any order, quantity, or importance, but rather are used to distinguish one element from another. The terms "front", "back", "bottom", and/or "top" are used herein, unless otherwise noted, merely for convenience of description, and are not limited to any one position or spatial orientation.

The endpoints of all ranges directed to the same component or property are inclusive of the endpoints, are independently combinable, and include all intermediate points. For example, ranges of "up to 25 N/m, or more specifically 5 to 20 N/m" are inclusive of the endpoints and all intermediate values of the ranges of "5 to 25 N/m," such as 10 to 23 N/m.

Unless defined otherwise, technical and scientific terms used herein have the same meaning as is commonly understood by one of skill in the art to which this invention belongs.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

As will be recognized by those of ordinary skill in the pertinent art, numerous modifications and substitutions can be made to the above-described embodiments of the present disclosure without departing from the scope of the disclosure. Accordingly, the preceding portion of this specification is to be taken in an illustrative, as opposed to a limiting, sense.

Although the disclosure has been described herein using exemplary techniques, algorithms, or processes for implementing the present disclosure, it should be understood by those skilled in the art that other techniques, algorithms and processes or other combinations and sequences of the techniques, algorithms and processes described herein may be used or performed that achieve the same function(s) and result(s) described herein and which are included within the scope of the present disclosure. In addition, unless otherwise recited herein, any embodiment disclosed herein may be used with any other embodiment disclosed herein.

Any process descriptions, steps, or blocks in process or logic flow diagrams provided herein indicate one potential implementation, do not imply a fixed order, and alternate implementations are included within the scope of the preferred embodiments of the systems and methods described herein in which functions or steps may be deleted or performed out of order from that shown or discussed, including substantially concurrently or in reverse order, depending on the functionality involved, as would be understood by those reasonably skilled in the art.

It is noted that the Figures are to be taken as an illustrative example only, and are not to scale.

All cited references are incorporated in their entirety to the extent needed to understand the present disclosure, and to the extent permitted by applicable law.

It should be understood that, unless otherwise explicitly or implicitly indicated herein, any of the features, characteristics, alternatives or modifications described regarding a particular embodiment herein may also be applied, used, or incorporated with any other embodiment described herein.

Conditional language, such as, among others, "can," "could," "might," or "may," unless specifically stated otherwise, or otherwise understood within the context as used, is generally intended to convey that certain embodiments could include, but do not require, certain features, elements, or steps. Thus, such conditional language is not generally intended to imply that features, elements, or steps are in any way required for one or more embodiments or that one or more embodiments necessarily include logic for deciding, with or without user input or prompting, whether these features, elements, or steps are included or are to be performed in any particular embodiment.

Although the invention has been described and illustrated with respect to exemplary embodiments thereof, the foregoing and various other additions and omissions may be made therein and thereto without departing from the spirit and scope of the present disclosure.

What is claimed is:

1. An inward-firing combustion burner, comprising:

a burner casing configured to receive a fuel-air mixture at a burner inlet and to provide hot combustion gas at a burner output;

a combustion substrate disposed within the burner casing, the substrate having a shape comprising at least a semi-cone, having a substrate angle measured from a longitudinal axis, having a substrate porosity defined by a plurality of pores, and having a substrate inner surface and a substrate outer surface;

the substrate configured to receive the fuel-air mixture at the outer surface of the substrate, the fuel-air mixture passing through the pores at a mixture flow rate from the substrate outer surface toward the substrate inner surface;

the burner configured such that, in operation, the fuel-air mixture ignites in a reaction zone near the plurality of pores to form a respective plurality of flamelets, each flamelet corresponding to one of the pores; and wherein the porosity is set such that a flame equilibrium ratio (p) balances a force due to the fuel-air mixture passing through the pores and an opposing force due to the reaction zone, for $1<\rho<100$.

2. The burner of claim 1, wherein the plurality of flamelets exhibits suspended flame combustion (SF combustion).

3. The burner of claim 1, wherein the substrate angle has a range of values from about 1 degree to less than 90 degrees.

4. The burner of claim 1 wherein a volume of the burner casing, a proximal diameter ($D_p$) of the substrate, a distal diameter ($D_d$) of the substrate, and a semi-cone angle of the substrate, are set such that the mixture rate is substantially uniform along a length of the substrate and the plurality of flamelets forms a substantially uniform flame front along the inner surface of the substrate.

5. The burner of claim 1, wherein each flamelet is disposed a flamelet separation distance from the substrate inner surface, the separation distance being determined by at least one of the substrate porosity and the mixture rate such that each flamelet does not move through its corresponding pore to the substrate outer surface, and such that each flamelet remains ignited while the fuel-air mixture is flowing.

6. The burner of claim 5 wherein the flamelet separation distance is related to at least one of: the substrate porosity, the mixture rate, and substrate angle.

7. The burner of claim 1, wherein the plurality of flamelets provides a substantially uniform temperature distribution across the substrate inner surface and provides a substantially uniform flow field distribution of the hot combustion gas at the burner output.

8. The burner of claim 1, wherein the substrate comprises a plurality of porous layers to create the substrate porosity.

9. The burner of claim 1, wherein the shape of the substrate comprises at least one of: cone, semi-cone, composite semi-cone, truncated cone, frustum, right frustum, right circular truncated cone, and right circular frustum.

10. The burner of claim 1, wherein the pores have a shape comprising at least one of: circular, rectangular, symmetrical shape, and asymmetrical shape.

11. Burner of claim 10, wherein the shape of at least one pore is an approximately circular of maximum diameter between about 0.5 millimeters and about 2 millimeters.

12. Burner of claim 10, wherein the shape of at least one pore is approximately a slot with width between about 0.5 millimeters and about 2 millimeters and length between about 2 millimeters and about 15 millimeters.

13. The burner of claim 1, further comprising a baffle, disposed between the substrate and the burner casing, and arranged to receive the fuel-air mixture.

14. The burner of claim 1, further comprising an ignitor disposed on an inner side of the substrate where combustion occurs.

15. The burner of claim 1, wherein the combustion substrate comprises a proximal diameter ($D_p$) between about 1 and about 59 inches, a distal diameter ($D_d$) between about 1 and about 60 inches, a substrate height (H) between about 1 and about 60 inches, and a substrate angle between about 1 degree and less than 90 degrees.

16. An inward-firing combustion burner, comprising:

a burner casing configured to receive a fuel-air mixture at a burner inlet and to provide hot combustion gas at a burner output;

a combustion substrate disposed within the burner casing, the substrate having a shape comprising at least a semi-cone, having a substrate angle measured from a longitudinal axis, having a substrate porosity defined by a plurality of pores, and having a substrate inner surface and a substrate outer surface;

the substrate configured to receive the fuel-air mixture at the outer surface of the substrate, the fuel-air mixture passing through the pores at a mixture flow rate from the substrate outer surface toward the substrate inner surface;

the burner configured such that, in operation, the fuel-air mixture ignites in a reaction zone near the plurality of pores to form a respective plurality of flamelets, each flamelet corresponding to one of the pores, wherein the plurality of flamelets exhibits suspended flame combustion (SF combustion) and the substrate angle is between about 1 degree and less than 90 degrees; and wherein the porosity is set such that a flame equilibrium ratio (p) balances a force due to the fuel-air mixture passing through the pores and an opposing force due to the reaction zone, for $1<\rho<100$.

* * * * *